US006318315B1

(12) United States Patent
Harada et al.

(10) Patent No.: US 6,318,315 B1
(45) Date of Patent: Nov. 20, 2001

(54) VALVE OPERATING SYSTEM FOR INTERNAL COMBUSTION ENGINE

(75) Inventors: Takeya Harada; Toshiki Kobayashi; Akira Kaburagi, all of Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/363,653

(22) Filed: Jul. 30, 1999

(30) Foreign Application Priority Data

Aug. 4, 1998 (JP) ..... 10-220311

(51) Int. Cl.[7] ..... F01L 1/34

(52) U.S. Cl. ..... 123/90.16; 123/90.15; 123/90.17

(58) Field of Search ..... 123/90.15, 90.16, 123/90.2, 90.21, 90.26, 90.39, 90.4, 90.44, 90.48

(56) References Cited

U.S. PATENT DOCUMENTS

| | | | | |
|---|---|---|---|---|
| 3,628,514 | * | 12/1971 | Phillips | 123/90.48 |
| 4,655,176 | * | 4/1987 | Sheehan | 123/90.16 |
| 4,762,096 | * | 8/1988 | Kamm et al. | 123/90.16 |
| 4,807,574 | * | 2/1989 | Shibata et al. | 123/90.16 |
| 4,829,948 | * | 5/1989 | Yoshida et al. | 123/90.16 |
| 4,911,124 | * | 3/1990 | Bennett | 123/90.4 |
| 5,460,130 | * | 10/1995 | Fukuzawa et al. | 123/90.16 |
| 5,553,584 | * | 9/1996 | Konno | 123/90.16 |
| 5,685,264 | * | 11/1997 | Allen et al. | 123/90.16 |
| 5,704,315 | * | 1/1998 | Tsuchida et al. | 123/90.16 |
| 5,845,614 | * | 12/1998 | Tanaka et al. | 123/90.16 |
| 5,954,018 | * | 9/1999 | Joshi | 123/90.16 |
| 5,960,754 | * | 10/1999 | Sugimoto et al. | 123/90.15 |

FOREIGN PATENT DOCUMENTS

| | | |
|---|---|---|
| 195 36 090 | 4/1997 | (DE) . |
| 0 826 867 | 3/1998 | (EP) . |

* cited by examiner

*Primary Examiner*—Sang Paik
*Assistant Examiner*—Fadi H. Dahbour
(74) *Attorney, Agent, or Firm*—Armstrong, Westerman, Hattori, McLeland & Naughton, LLP

(57) ABSTRACT

In a valve operating system for an internal combustion engine, wherein connected and disconnected states of cam followers can be switched over from one to another to change the valve operating characteristic of an engine valve, each cam follower includes a cam follower body having a pair of support walls integrally provided thereon and arranged in parallel to sandwich a roller therebetween, and a hollow roller shaft which is fitted and supported at outer peripheries of its opposite ends in through-bores in the support walls, and which has the roller rotatably carried at its intermediate portion. A first groove is defined in an outer peripheral surface of the through-bore in one support wall to extend circumferentially of the through-bore, and a second groove is defined in an outer peripheral surface of the roller shaft at its one end corresponding to the first groove. A C-shaped resilient fastener is mounted in the first and second grooves and is capable of engaging with inner surfaces of the grooves astride them. The switching pin is slidably fitted to inner peripheral surfaces of the roller shafts of adjacent cam followers. With such arrangement, the roller shaft of the rollered cam follower can simply be fixed to the support wall of the cam follower body without caulking equipment, and a protrusion for fixing the roller shaft is not created on an outer surface of the support wall. The roller shaft is also used as a portion of a cam follower connecting mechanism.

36 Claims, 21 Drawing Sheets

VALVE OPERATING SYSTEM FOR INTERNAL COMBUSTION ENGINE

BACKGROUND OF THE INVENTION

1. Field of the Invention

The present invention relates to a valve operating system for an internal combustion engine, which uses a rollered cam follower including a pair of support walls which are integrally formed on a cam follower body and arranged in parallel to sandwich a roller therebetween, so that outer peripheries of opposite ends of a roller shaft having the roller rotatably carried thereon are supported in through-bores in the support walls, and particularly, to a valve operating system suitable for an internal combustion engine, which includes a plurality of rollered cam followers disposed adjacent one another and having rollers put into contact with a plurality of cams, respectively, at least a portion of the cam followers being operatively connected to an engine valve, so that the valve operating characteristic of the engine valve can be changed by the movement of a switching pin which is mounted to be slidingly movable astride adjacent cam followers, thereby enabling the connected and disconnected states of the cam followers to be switched over from one to another.

2. Description of the Related Art

The above-described rollered cam follower is designed so that the slidability and the followability with respect to a cam of the cam follower are enhanced by the roller placed in contact with the cam. Such rollered cam follower is conventionally widely used In valve operating systems for Internal combustion engines.

In the conventional rollered cam follower, there are known methods for fixing the roller shaft, for example, to strike and caulk the opposite end faces of the roller shaft with a caulking punch, as shown in Japanese Patent Application Laid-open No.5-321999, and to use a bolt-shaped roller shaft and tighten and fix the shaft end outside the support wall by a nut, as shown in Japanese Utility Model Application Laid-open No.57-98350.

However, when the roller shaft is fixed by caulking, there is a problem that equipment for caulking processing is specially required, resulting in an increase in cost.

When a hollow roller shaft is used, deformation or strain is liable to be produced in the roller shaft due to the caulking. Particularly, when the deformation or strain has been produced in an outer peripheral surface of the roller shaft, certain disadvantages are encountered, such that a roller-rolling face is not smooth and the roller cannot be rotated smoothly on the roller-rolling face. Particularly, when a switching pin capable of connecting the cam followers in order to change the valve operating modes has been slidably fitted In a hollow portion of the roller shaft, the slidability of the switching pin may be injured due to the deformation or strain of the inner peripheral surface of the roller shaft in some cases, whereby the changing of the valve operating modes cannot be performed properly.

On the other hand, when the roller shaft is fixed by the bolt and the nut, the following problem is encountered: The head of the bolt and the nut protrude from the outer surfaces of the support walls, and the width of the cam follower (the maximum dimension in a direction along the roller shaft) is increased more than required. To solve the above problem due to the bolt and the nut, it is conceived to fix the roller shaft in the through-bore in the support wall by use of a resilient fastener such as a circlip. In this case, however, it is desirable that the shape and the disposition of a groove for mounting of the fastener defined in the support wall is taken into a special consideration, so that problems in respect of the strength and the like may not arise despite the defining of the groove.

SUMMARY OF THE INVENTION

Accordingly, it is an object of the present invention to provide a valve operating system for an internal combustion engine, wherein the above problems associated with the conventional valve operating system can be solved.

To achieve the above object, according to a first aspect and feature of the present invention, there is provided a valve operating system for an internal combustion engine, comprising at least two rollered cam followers arranged adjacent each other and having rollers put in contact with a plurality of cams, at least one of the cam followers being operatively connected to an engine valve, so that the valve operating characteristic of the engine valve can be changed by moving a switching pin mounted in adjacent ones of the cam followers for sliding movement astride the adjacent cam followers, thereby enabling connected and disconnected states of the cam followers to be switched over from one to another, wherein each of the cam followers comprises a cam follower body having a pair of support walls integrally provided thereon and arranged in parallel to sandwich the roller therebetween, and a hollow roller shaft which is fitted and supported at outer peripheries of opposite ends thereof in through-bores in the support walls, the roller shaft having the roller rotatably carried at an intermediate portion thereof; and the system further includes a first groove defined in an inner peripheral surface of the through-bore in one of the support walls to extend in a circumferential direction of the through-bore, a second groove defined in an outer peripheral surface of the roller shaft at one end thereof corresponding to the first groove, and a C-shaped resilient fastener mounted in the first and second grooves and capable of engaging with inner surfaces of the grooves astride the grooves to limit an axial relative movement of the roller shaft and the support walls, the switching pin being slidably fitted to inner peripheral surfaces of the roller shafts of the adjacent cam followers.

With the above arrangement, the axial relative sliding movement of the roller shaft relative to the through-bores in the support walls in the roller shaft can be reliably inhibited by the C-shaped resilient fastener disposed between the fitted faces of one end of the roller shaft of the rollered cam follower and through bore in one of the support walls of the cam follower body (i.e., between the first and second grooves). Therefore, the roller shaft can be fixed in a slip-off preventing manner to the support wall without special use of a caulking equipment. Moreover, a protrusion for fixing the roller shaft is not present on the outer surface of the support wall and hence, the width of the cam follower can be decreased correspondingly. In addition, particularly, the roller shaft is hollow, and the switching pin for switching-over the connected and disconnected states of the adjacent cam followers is slidably fitted to the inner peripheral surface of the roller shaft. Therefore, the roller shaft can also be used as a portion of a cam follower connecting mechanism, leading to a correspondingly simplified structure. In fixing the roller shaft, there is not a possibility that any deformation or strain is produced in the roller shaft as when the roller shaft is fixed by caulking. Therefore, not only the outer peripheral surface (the roller rolling face) and the inner peripheral surface (the switching pin sliding face) of the roller shaft can be formed into smooth surfaces to the utmost. Therefore, the rotation of the roller on the outer peripheral surface of the roller shaft is smooth, but also the switching pin can be slid smoothly on the inner peripheral surface of the roller shaft, whereby the valve operating characteristic can be switched over precisely.

In addition to the above arrangement, if a closing wall is provided outside the other support wall in one cam follower to define a working oil chamber between the closing wall and the switching pin, the closing wall is positioned outside one of the pair of support walls of the cam follower, on which the resilient fastener is not present (i.e., the other wall). Therefore, even if the roller shaft is inserted into the support wall from the side opposite to the closing wall to keep out of the closing wall, the resilient fastener can be positioned on the side of insertion opening and hence, the assembling operation can be easily performed without difficulty and without being influenced by the presence of the closing wall.

In addition to the above arrangement, if the roller is carried on the outer periphery of the roller shaft through needles, and that area of the outer peripheral surface of the roller shaft, which extends from its central needle-rolling face to an outer area past inner end edges of the through-bores, has been subjected at least to a hardening treatment, the wear of the needle rolling face can be reduced, and the roller can be rotated smoothly on the rolling face over a log period of time. Moreover, that portion of the outer periphery of the roller shaft receiving a larger struck load (a shearing load) applied thereto from the cam, which corresponds to a boundary between each of the support walls and the roller (i.e., a portion in the vicinity of each of the inner end edges of the through-bores) can be effectively reinforced to effectively avoid the deformation and the fracture of the roller shaft due to the shearing load.

In addition to the above arrangement, if the inner surface of the second groove in the outer peripheral surface of the roller shaft has been subjected to a hardening treatment, the wear of the inner surface of the second groove due to the vibration or the sliding movement of the resilient fastener in the second groove is reduced and hence, the slip-off preventing effect provided by the resilient fastener is maintained well over a long period of time.

In addition to the above arrangement, if at least that end of the hollow roller shaft, the switching pin is inserted into and removed from, has been subjected to a hardening treatment, the wear of the end of the roller shaft due to the delivery of the switching pin between the roller shafts of the adjacent cam followers can be reduced.

In addition to the above arrangement, if the two cam followers disposed adjacent each other are disposed so that the other ends of the roller shafts with the second groove not present therein adjoin each other, the insertion and removal of the switching pin for changing the valve operating characteristic is performed at those ends of the roller shaft and the cam follower, in which the first and second grooves are not present therein (therefore, the rigidity is not reduced). Thus, the insertion and removal of the switching pin can be performed always smoothly. Even in a state in which the switching pin is located astride the two roller shaft, i.e., in a state in which the adjacent cam followers have been connected to each other, the connecting load can be received by a portion having a relatively high rigidity, which is convenient for increasing the connection strength.

In addition, each of the first and second grooves is formed into a C-shape, so that the relative rotation of the roller shaft and the support wall is limited by the C-shaped resilient fastener. That area of the inner peripheral portion of the through-bore in the one support wall, which is sandwiched between opposite ends of the first groove, may be disposed to correspond to a free end of the one support wall. Thus, the free end of the support wall of the cam follower need not be formed to be specially thicker, despite the provision of the first groove. Therefore, the inertial mass of the free end of the support wall is reduced, and the followability of the cam follower to the cam is enhanced.

In addition to the above arrangement, each of the first and second grooves is formed into a C-shape, so that the relative rotation of the roller shaft and the support wall is limited by the C-shaped resilient fastener. The cam followers include a particular cam follower which is not operatively connected to the engine valve in the disconnected state of the cam followers, and the particular cam follower may be provided with a portion receiving the biasing force of the biasing means for normally biasing the particular cam follower toward the corresponding cam. The receiving portion may be disposed such that an area of the inner peripheral surface of the through-bore in the one support wall in the particular cam follower, which is sandwiched between the opposite ends of the first groove, corresponds to the receiving portion provided on the one support wall. Thus, even if the first groove is defined in the inner peripheral surface of the through-bore in the one support wall, a reduction in rigidity of the receiving portion in the one support wall can be avoided to the utmost only by limiting the peripheral position of the groove, as described above, and a reduction in size of the cam follower body is provided.

In addition to the above arrangement, each of the first and second grooves is formed into a C-shape, so that the relative rotation of the roller shaft and the support wall is limited by the C-shaped resilient fastener. The cam followers include a particular cam follower which is not operatively connected to the engine valve in the disconnected state of the cam followers, the particular cam follower being engaged by biasing means for normally biasing the particular cam follower toward a corresponding cam that portion of the one support wall in the particular cam follower which is opposed to the biasing means may be formed thicker in a radial direction of the roller shaft, so that an outer surface of the portion protrudes toward the biasing means. The thicker portion is a portion receiving the biasing force of the biasing means, and the first groove may be located between two planes extending through opposite sides of the receiving portion and perpendicular to the axis of the roller shaft. Thus, the biasing force of the biasing means can be received stably by the thicker receiving portion. In addition, even if the first groove is defined in the inner peripheral surface of the through-bore in the one support wall, a reduction in rigidity due to the formation of the groove can be effectively compensated for by the thicker receiving portion.

In addition to the above arrangement, each of the first and second grooves is formed into a C-shape, so that the relative rotation of the roller shaft and the support wall is limited by the C-shaped resilient fastener. An area of the inner peripheral portion of the through-bore in the one support wall, which is sandwiched between opposite ends of the first groove, may be disposed to correspond to that portion of the cam follower body to which a compressing load is applied during a lifting operation. Thus, even if the first groove is defined in the inner peripheral surface of the through-bore in the one support wall, the compressing load-applied portion having a larger load burden during the lifting operation provided by the cam in the cam follower body need not be formed to be specially thicker, and hence, the size and weight of the cam follower body are reduced correspondingly.

In addition to the above arrangement, each of the first and second grooves may be formed into a C-shape, so that the relative rotation of the roller shaft and the support wall is limited by the C-shaped resilient fastener. Thus, the roller shaft can be reliably fixed both in an axial direction and in a rotational direction to the support wall by engagement of the fastener with the first and second grooves.

In addition to the above arrangement, opposite ends faces of the fastener may be formed flat and inclined with respect to a phantom plane extending radiately from the axis of the roller shaft toward the end of the fastener, and opposite inner end faces of the first and second C-shaped grooves opposed to the opposite end faces of the fastener may be formed into flat faces parallel to the corresponding opposite end faces of the fastener, respectively. Thus, the end faces of the fastener and the inner end faces of each of the grooves opposed to the end faces can be brought into face contact with each other with a sufficient wide contact area and hence, can be precisely brought into engagement with each other to reliably prevent the rotation of the roller shaft. Moreover, the surface pressure of contact between the end faces of the fastener and the inner end faces of the hollow portion (each groove) can be reduced effectively to largely contribute to a reduction in wear of the contact portions.

In addition to the above arrangement, each of the inner end faces of the C-shaped first groove may be extended diametrically outwards past an outer peripheral edge portion of the fastener end face opposed to the inner end face of the first groove. Thus, a V-shaped recess (such a recess is liable to become a starting point for concentration of a stress) corresponding to the edge portion of the end face of the fastener is not present in the inner end face of the first groove in the support wall. Therefore, it is possible to effectively prevent the generation of fissures and cracks in the inner end face of the first groove due to the abutment of the:inner end face against the edge portion and hence, the strength of supporting of the roller shaft by the support wall is increased.

In addition to the above arrangement, a phantom plane connecting the axis of the roller shaft and the rotational axis of the cam may be provided to pass through that area of the inner peripheral portion of the through-bore in the one support wall, which is sandwiched between the opposite ends of the first groove. Thus, the first groove can be defined to keep out of a stress-concentrated site produced due to a struck load applied from the cam substantially along the phantom plane to the roller shaft (the through-bore in the support wall). Therefore, reductions in rigidity and strength of such site is inhibited despite the provision of the first groove, which is particularly convenient when the cam follower body is formed of an aluminum-based metal material. In this case, if the phantom plane passes through a central portion of the above-described area, the reductions in rigidity and strength of the stress-concentrated site are inhibited further effectively.

In addition to the above arrangement, if the cam follower body is formed of an aluminum-based metal material, the weight of the cam follower and in its turn, the inertial mass can be reduced.

According to a second aspect and feature of the present invention, there is provided a valve operating system for an internal combustion engine, comprising at least two rollered cam followers arranged adjacent each other and having rollers put in contact with a plurality of cams, the cam followers, excluding one of them, being operatively connected to an engine valve, so that the valve operating characteristic of the engine valve can be changed by moving a switching pin mounted in adjacent ones of the cam followers for sliding movement astride the adjacent cam followers, thereby enabling connected and disconnected states of the cam followers to be switched over from one to another, the one cam follower being provided with a portion receiving the biasing force of a biasing means for normally biasing the one cam follower toward a corresponding valve operating cam, wherein the one cam follower comprises a cam follower body having a pair of support walls integrally provided thereon and arranged in parallel to sandwich the roller therebetween, and a roller shaft which is fitted and supported at outer peripheries of opposite ends thereof in through-bores in the support walls, the roller shaft having the roller rotatably carried on an intermediate portion, and the valve operating system further Includes a first groove which is defined in an inner peripheral surface of the through-bore on one of the support walls to extend in a circumferential direction of the through-bore, a second groove which is defined in an outer peripheral surface of one end of the roller shaft corresponding to the first groove, and a C-shaped resilient fastener mounted in the first and second grooves and capable of engaging with inner surfaces of the grooves astride the grooves to limit an axial relative movement of the roller shaft and the support walls, the receiving portion being formed on the other support wall.

With the above arrangement, in the particular cam follower, the axial relative sliding movement of the roller shaft relative to the through-bore in the support wall can be reliably inhibited by the C-shaped resilient fastener disposed between fitted faces of one end of the roller shaft and through-bore in one of the support wall of the cam follower body (between the first and second grooves). Therefore, the slip-off of the roller shaft can be prevented simply without special use of a caulking equipment. Moreover, a protrusion for fixing the roller shaft is not present on the outer side of the support wall and hence, the width of the cam follower can be reduced correspondingly. The receiving portion for the biasing means is located on the side of the particular cam follower on which the resilient fastener is present, i.e., on the support wall free of the first groove (on the other support wall), and there is not a possibility that the rigidity of the receiving portion is reduced due to the presence of the first groove. Therefore, a sufficient rigidity can be ensured in the receiving portion without a special reinforcement.

In addition to the above arrangement, if the roller is carried on the outer periphery of the roller shaft through needles, and that area of the outer peripheral surface of the roller shaft, which extends from a central needle-rolling face to an outer area past inner end edges of the through-bores, has been subjected at least to a hardening treatment, the wear of the needle rolling face can be reduced, and the roller can be rotated smoothly on the rolling face over a long period of time. Moreover, that portion of the outer periphery of the roller shaft receiving a larger struck load (a shearing load) applied thereto from the cam, which corresponds to a boundary between each of the support walls and the roller (i.e., a portion in the vicinity of each of the inner end edges of the through-bores) can be effectively reinforced to effectively avoid the deformation and the fracture of the roller shaft due to the shearing load.

In addition to the above arrangement, if the inner surface of the second groove in the outer peripheral surface of the roller shaft has been subjected to a hardening treatment, the wear of the inner surface of the second groove due to the vibration or the sliding movement of the resilient fastener in the second groove is reduced and hence, the slip-off preventing effect provided by the resilient fastener is maintained well over a long period of time.

In addition to the above arrangement, if at least that end of the hollow roller shaft, the switching pin is inserted into and removed from, has been subjected to a hardening treatment, the wear of the end of the roller shaft due to the delivery of the switching pin between the roller shafts of the adjacent cam followers can be reduced.

In addition to the above arrangement, if each of the first and second grooves is formed into a C-shape, so that the relative rotation of the roller shaft and the support wall is limited by the C-shaped resilient fastener, the roller shaft can be reliably fixed both in an axial direction and in a rotational direction on the support wall by engagement of the fastener with the first and second grooves.

In addition to the above arrangement, opposite end faces of the fastener may be formed flat and inclined with respect to a phantom plane extending radiately from the axis of the roller shaft toward the end of the fastener, and opposite inner end faces of the first and second C-shaped grooves opposed to the opposite end faces of the fastener may be formed into flat faces parallel to the corresponding opposite end faces of the fastener, respectively. Thus, the end faces of the fastener and the inner end faces of each of the grooves opposed to the end faces can be brought into face contact with each other with a sufficient wide contact area and hence, can be precisely brought into engagement with each other to reliably prevent the rotation of the roller shaft. Moreover, the surface pressure of contact between the end faces of the fastener and the inner end faces of the hollow portion (each groove) can be reduced effectively to largely contribute to a reduction in wear of the contact portions.

In addition to the above arrangement, each of the inner end faces of the C-shaped first groove may be extended radially outwards past an outer peripheral edge portion of the fastener end face opposed to the inner end face of the first groove. Thus, a V-shaped recess (such a recess is liable to become a starting point for concentration of a stress) corresponding to the edge portion of the end face of the fastener is not present in the inner end face of the first groove in the support wall. Therefore, it is possible to effectively prevent the generation of fissures and cracks in the inner end face of the first groove due to the abutment of the inner end face against the edge portion and hence, the strength of supporting of the roller shaft by the support wall is increased.

In addition to the above arrangement, if the cam follower body is formed of an aluminum-based metal material, the weight of the cam follower and in its turn, the inertial mass can be reduced.

BRIEF DESCRIPTION OF THE DRAWINGS

FIGS. 2A and 2B are enlarged sectional views taken along a line 2—2 in FIG. 1, wherein FIG. 2A shows a state in which cam followers have been connected to each other, and FIG. 2B shows a state in which the cam followers have been disconnected from each other;

DESCRIPTION OF THE PREFERRED EMBODIMENTS

The present invention will now be described by way of embodiments shown in the accompanying drawings.

A first embodiment of the present invention with a rollered cam follower applied to a valve operating system for an internal combustion engine will be described with reference to FIGS. 1 to 4.

Figure 1:
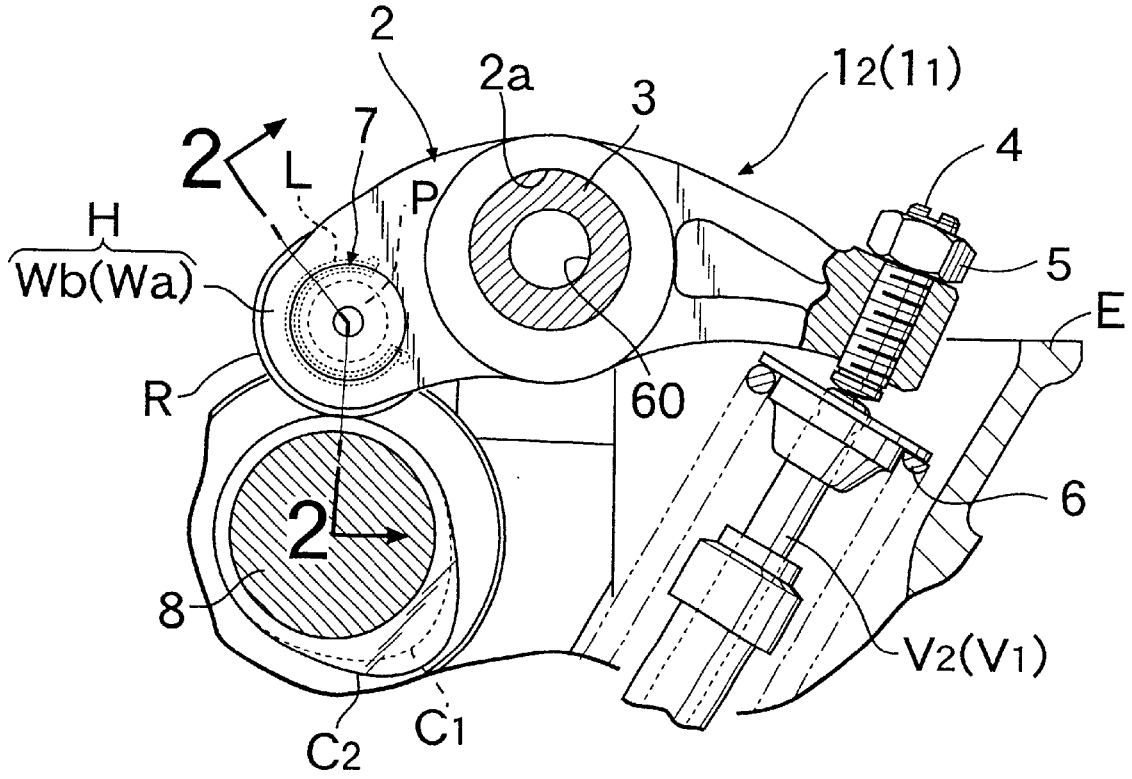
FIG. 1 is a sectional view of an essential portion of a valve operating system for an internal combustion engine according to a first embodiment of the present invention.

Referring to FIGS. 1 and 2, two rollered rocker arms $\mathbf{1}_1$ and $\mathbf{1}_2$ as rollered cam followers are arranged adjacent each other at an upper portion of an engine body E and swingably carried on a common rocker shaft 3 fixed to the engine body E. Rollers R, R of the first and second rocker arms $\mathbf{1}_1$ and $\mathbf{1}_2$ are in contact with two cams (a low-speed cam $C_1$ and a high-speed cam $C_2$ in the illustrated embodiment) arranged on a cam shaft 8 rotatably carried on the engine body E and rotated in association with a crankshaft (not shown) of the internal combustion engine. The low-speed cam $C_1$ and the high-speed cam $C_2$ are formed to accommodate to a low-speed operation and a high-speed operation of the engine, respectively and moreover, formed so that the high-speed cam $C_2$ is higher in lift than the low-speed cam $C_1$.

A shaft bore 2*a* is defined in a lengthwise intermediate portion of a rocker arm body 2 of each of the rocker arms $\mathbf{1}_1$ and $\mathbf{1}_2$, and a rocker shaft 3 is relatively rotatably mounted through the shaft bore 2*a*. An adjusting bolt 4 is screwed in a base portion of each of the rocker arm bodies 2, so that the screwed position thereof is fixed by a rock nut 5. Two intake valves $V_1$ and $V_2$ as engine valves per cylinder are vertically slidably carried on the engine body E with their upper ends abutting against lower ends of the adjusting bolts 4. The valves $V_1$ and $V_2$ are always biased in a closing direction by resilient force of a valve spring 6 (a direction to abut against the adjusting bolts 4).

The roller R is rotatably mounted at a tip portion of each of the rocker arm bodies 2 through a roller shaft 7, and the cams $C_1$ and $C_2$ are brought into pressure contact with outer peripheral surfaces of the rollers R by the resilient force of the valve spring 6. If the low-speed and high-speed cams $C_1$ and $C_2$ are rotated in association with the crankshaft, the first and second rocker arms $\mathbf{1}_1$ and $\mathbf{1}_2$ abutting against the cams $C_1$ and $C_2$ through the rollers R can be vertically swung about the rocker shaft 3 to open and close the corresponding intake valves $V_1$ and $V_2$.

Figure 2A:
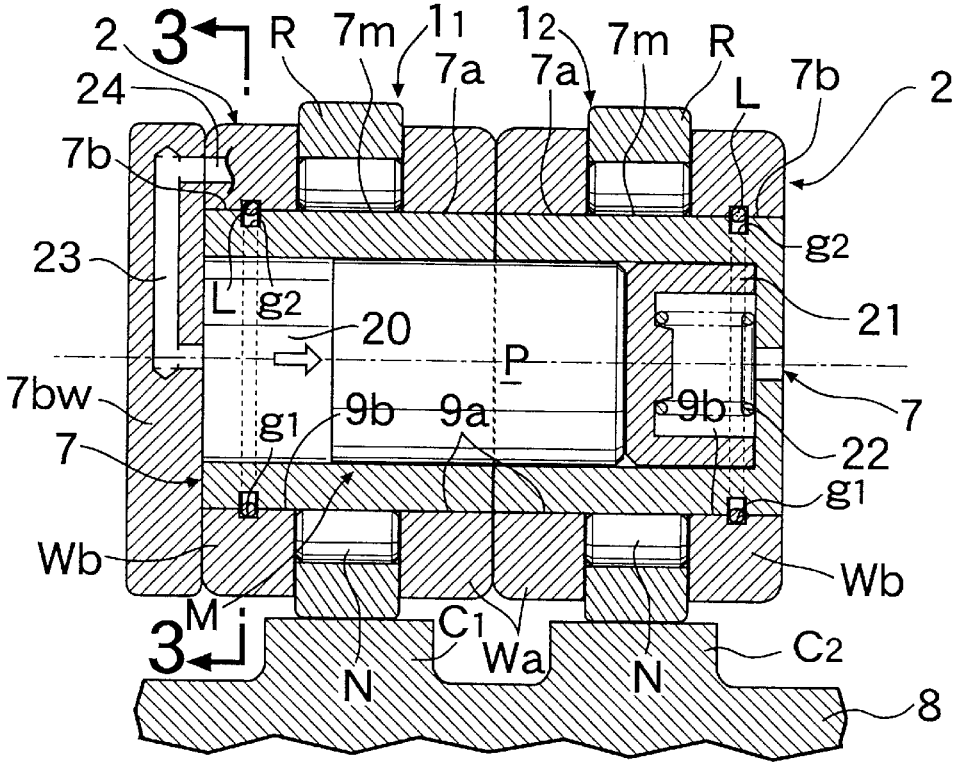

The structure of mounting of the rollers R and the roller shafts 7 (mounting structure for both the rocker arms $\mathbf{1}_1$ and $\mathbf{1}_2$ is basically the same) will be described in detail with reference to FIGS. 2 to 4. A fork-shaped roller retaining In portion H are integrally formed at the tip portions of the rocker arm bodies 2 of the rocker arms $\mathbf{1}_1$ and $\mathbf{1}_2$ and has pairs of first and second support walls Wa and Wb arranged in parallel at a distance to sandwich the roller R therebetween. Through-bores 9*a* and 9*b* are coaxially defined across the support walls Wa and Wb, and outer peripheries of opposite ends of the roller shafts 7 are supported in the through-bores 9*a* and 9*b* in a fitted manner, respectively.

The roller shaft 7 is formed into a hollow cylindrical shape with at least one end opened and with its diameter constant over the entire length. An outer peripheral surface of a lengthwise central portion 7*m* of the roller shaft 7 is a roller rolling surface, on which an inner periphery of the roller R is rotatably carried through a large number of needles N arranged in a circumferential direction thereof. The outer end faces of the roller shafts 7 are formed so that they do not protrude from outer surfaces of the support walls Wa and Wb (particularly, so that they are flush with the outer surfaces in the illustrated embodiment). On the other hand, the through-bores 9*a* and 9*b* in the support walls Wa and Wb are each formed into an arcuate shape with its inside diameter being constant over the entire width and moreover, being set to be substantially equal to the outside diameter of the roller shaft 7, so that they are fitted with the opposite ends 7*a* and 7*b* of the roller shafts 7 closely (i.e., for axial sliding movement, but with no looseness in a diametrical direction).

A first groove $g_1$ having a C-shaped cross section is defined on the inner peripheral surface of the through-bore 9*b* in one of the support walls (the second support wall Wb in the illustrated embodiment) to extend in the circumferential direction of the through-bore 9*b*. A second groove $g_2$ having a C-shaped cross section is defined in the outer peripheral surface of that one end of the roller shaft 7 which corresponds to the one support wall Wb (the second end in the illustrated embodiment) to extend in the circumferential direction of the roller shaft 7 in correspondence to the first groove $g_1$, and no groove is defined on the outer periphery of the other end of the shaft 7 (the first end in the illustrated embodiment). A C-shaped hollow portion G is defined between the first and second grooves $g_1$ and $g_2$ between fitted surfaces of the through-bore 9*b* in the second support wall Wb and the second end 7*b* of the roller shaft 7. A circlip L formed of a metal into the substantially same C-shape as the hollow portion G is mounted in the hollow portion G and constitutes a resilient fastener of the present invention.

The circlip L, in a state in which it has been set in the hollow portion G, can inhibit the relative rotation of the roller shaft 7 and the support walls Wa and Wb by one end face in contact with inner surfaces of one ends of the grooves $g_1$ and $g_2$ astride them and the other end in contact with inner surfaces of the other ends of the grooves $g_1$ and $g_2$ astride them, and also can inhibit the axial relative movement of the roller shaft 7 and the support walls Wa and Wb by one side in contact with the inner surfaces of one sides of the grooves $g_1$ and $g_2$ astride them and the other side in contact with the inner surfaces of the other sides of the grooves $g_1$ and $g_2$ astride them.

The circlip L is formed so that its diameter is larger than the outside diameter of the roller shaft 7 (therefore, the inside diameter of the through-bores 9*a* and 9*b*) and also than inside diameter of the first groove $g_1$ in its free state. Therefore, The outer peripheral surface of the circlip L, in the state in which it has been set in the hollow portion G, is in pressure contact with the inner bottom surface of the first groove $g_1$ under the action of a resilient restoring force of the circlip L itself. The second groove $g_2$ in the roller shaft 7 has a depth which is set so that it can be forcibly deformed in a resiliently shrunk manner by a first jig (not shown), until the circlip L fitted in the second groove $g_2$ is immersed into the second groove $g_2$. A somewhat play is established in the circumferential direction of the circlip L between opposite ends of the circlip L and opposite inner ends of the C-shaped hollow portion G, so that the diametrical resilient deformation during assembling of the circlip L can be permitted under no compulsion.

Each of the roller shafts 7, 7 of the first and second rocker arms $\mathbf{1}_1$ and $\mathbf{1}_2$ is formed:into a bottomed cylindrical shape with its second end 7*b*, 7*b* closed by a closing wall integral with or separate from the shaft 7 and with its first end 7*a*, 7*a* opened. Moreover, the roller shafts 7, 7 are arranged, so that their first ends 7*a*, 7*a*, with the second groove $g_2$ being not defined therein, adjoin each other.

A connection switch-over mechanism M is provided in the first and second rocker arms $\mathbf{1}_1$ and $\mathbf{1}_2$ and is capable of switching-over the state in which the first and second rocker arms $\mathbf{1}_1$ and $\mathbf{1}_2$ have been connected to each other and the state in which the first and second rocker arms $\mathbf{1}_1$ and $\mathbf{1}_2$ have been disconnected from each other. The connection switch-over mechanism M includes a switching pin P which is fitted to the inner peripheral surfaces of the roller shafts 7, 7 of the first and second rocker arms $\mathbf{1}_1$ and $\mathbf{1}_2$ for sliding movement astride the inner peripheral surfaces to enable the first and second rocker arms $\mathbf{1}_1$ and $\mathbf{1}_2$ to be switched over between the connected state and the disconnected state, a movement limiting member 21 slidably fitted to the inner peripheral surface of the roller shaft 7 of the second rocker arm $\mathbf{1}_2$ to define a retreating limit for the switching pin P, and a return spring 22 for biasing the switching pin P and the limiting member 21 in a disconnecting direction (leftwards as viewed in FIG. 2).

A closing wall 7*bw* for closing the opened end of the roller shaft 7 is secured in a post-mounted manner (i.e., after completion of assembling of the roller shaft 7) to the outside of the second support wall Wb of the first rocker arm $\mathbf{1}_1$, and a working oil chamber 20 is defined between the closing wall 7*bw* and the switching pin P. The working oil chamber 20 is always in communication with an oil supply passage 60 within the rocker shaft 3 via oil passages 23 and 24 defined in the closing wall 7*bw* and the rocker arm body 2 of the first rocker arm $\mathbf{1}_1$, respectively. The oil supply passage 60 can be selectively switchably put into communication with any of a hydraulic pressure source and an oil tank (both not shown) depending on the operational state of the engine. Therefore, in a state in which the oil supply passage 60 is in communication with the hydraulic pressure source and a working oil under a high pressure has been supplied to the working oil chamber 20, the switching pin P biased in a retreating direction by the hydraulic pressure of the working oil is in its connecting state (at a retreating limit) shown in FIG. 2A to integrally connect the rocker arms $\mathbf{1}_1$ and $\mathbf{1}_2$ to each other. On the other hand, in a state in which the working oil chamber 20 is in a hydraulic pressure-released state in which it is in communication with the oil tank, the switching pin P biased in an advancing direction by the resilient force of the return spring 22 is in a disconnecting state to disconnect the rocker arms $\mathbf{1}_1$ and $\mathbf{1}_2$ from each other. The function of a pin-switched valve operating characteristic changing mechanism of such a two-rocker type is conventionally well-known in the internal combustion engine and hence, further description thereof is omitted.

Figure 2B:
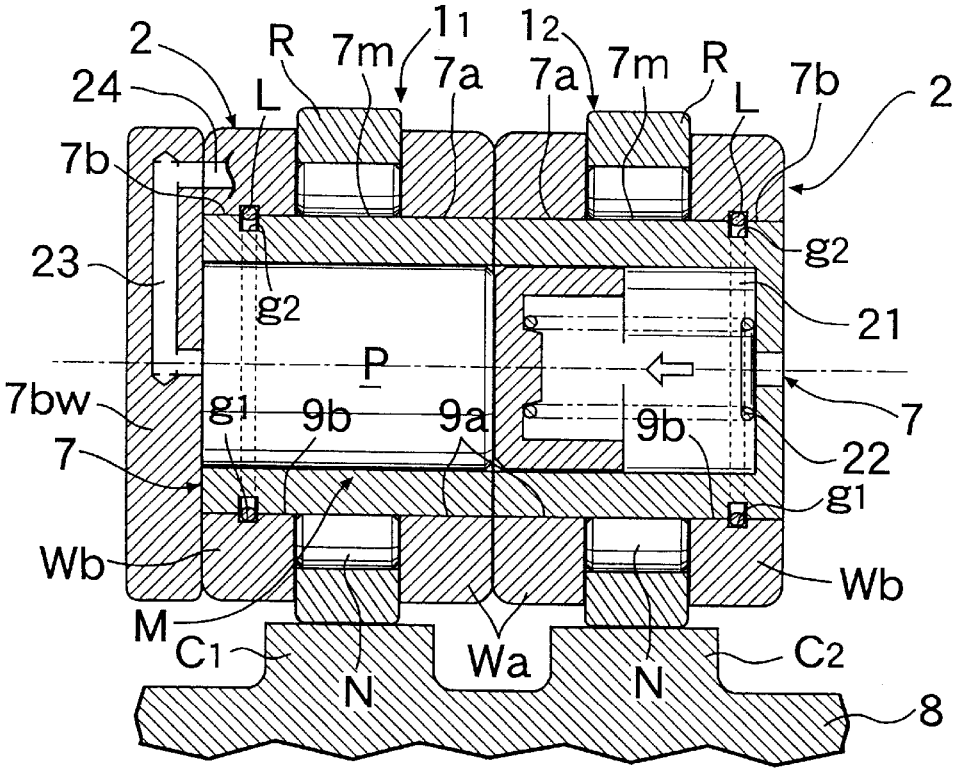
Figure 3:
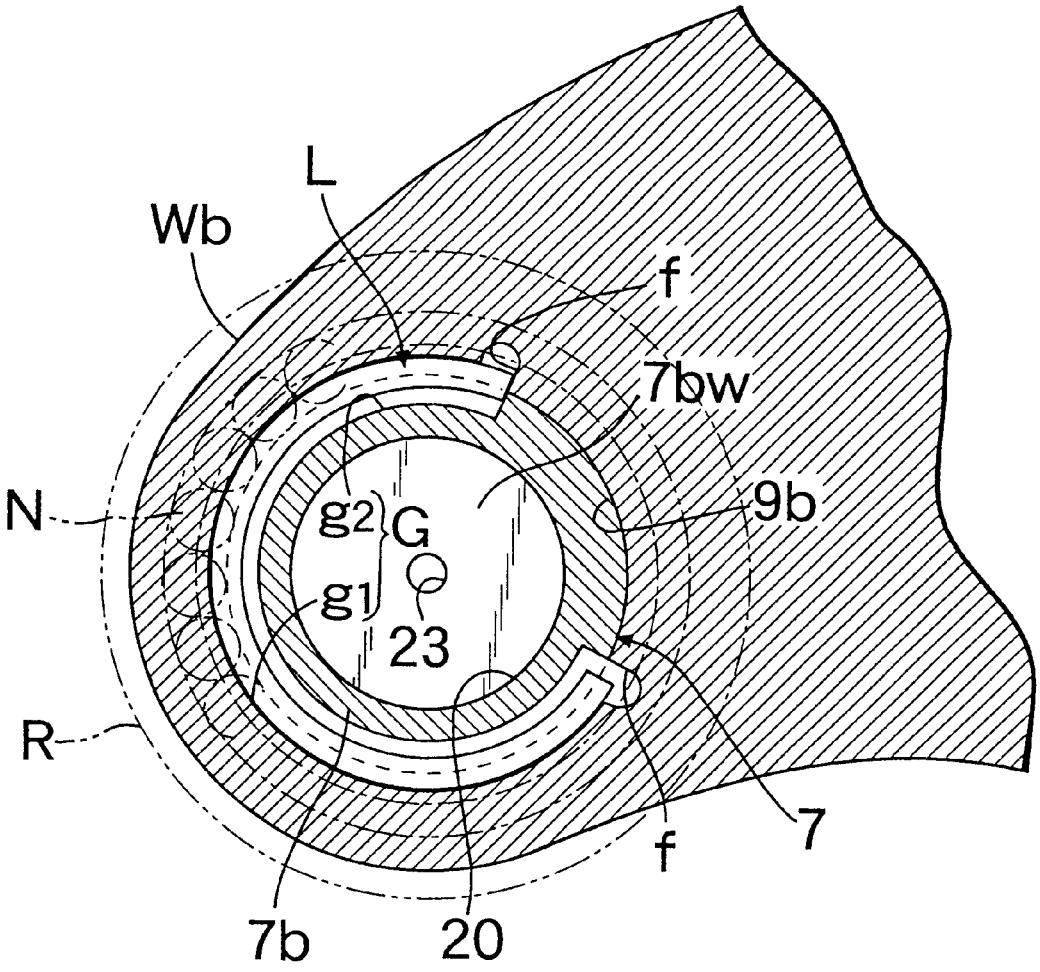
FIG. 3 is a sectional view taken along a line 3—3 in FIG. 2.

During operation of the engine at a low speed, the inside of the working oil chamber 20 is put in its hydraulic pressure-released state to maintain the rocker arms $\mathbf{1}_1$ and $\mathbf{1}_2$ in their disconnected states shown in FIG. 2B. In this state, the first rocker arm $\mathbf{1}_1$ is swung in response to the low-speed cam $C_1$by the rotation of the cam shaft 8 to open and close the first intake valve $V_1$, while the second rocker arm $\mathbf{1}_2$ is swung in response to the high-speed cam $C_2$ to open and close the second intake valve $V_2$. In this way, a valve operating mode corresponding to the low-speed operation is provided as a whole.

When the engine is in a high-speed operational state, the working oil pressure is supplied into the working oil chamber 20, whereby the rocker arms $\mathbf{1}_1$ and $\mathbf{1}_2$ are maintained in their connected states shown in FIG. 2A. In this state, the second rocker arm $\mathbf{1}_2$ in contact with the high-speed cam $C_2$ is swung in an amount larger than that of the first rocker arm $\mathbf{1}_1$, and hence, the first rocker arm $\mathbf{1}_1$ is swung in unison with the second rocker arm $\mathbf{1}_2$ to open and close the intake valves $V_1$ and $V_2$ in a valve operating mode for a high-speed operation corresponding to the shaft of the high-speed cam $C_2$, leading to an increased engine power output.

In the first embodiment, the fixing of the hollow roller shaft 7 is performed using the C-shaped resilient circlip L, and hence, there is not a possibility that a deformation or a strain is produced in the roller shaft 7 as in the fixing performed by caulking and the inner peripheral surface of the roller shaft 7 is formed smoothly. Therefore, the switching pin P can slide smoothly on the inner peripheral surface of the roller shaft 7 and hence, the switching-over of the valve operating characteristics is carried out precisely.

Figure 4B:
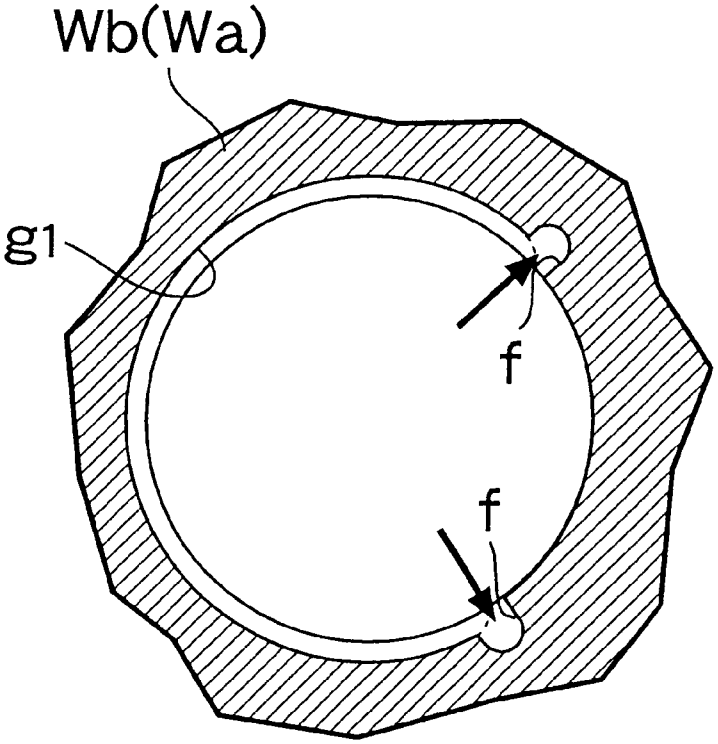
FIGS. 4A and 4B are views for briefly explaining a step of forming a first groove in a cam follower body.
Figure 4A:
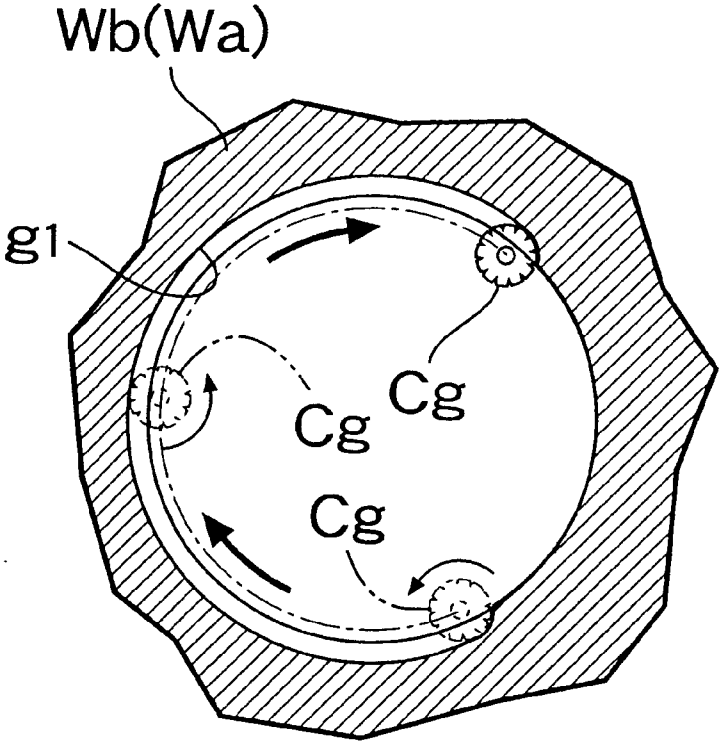

To produce the rocker arms $\mathbf{1}_1$ and $\mathbf{1}_2$ having the above-described structure, a rocker arm body 2 for each of the rocker arms $\mathbf{1}_1$ and $\mathbf{1}_2$ is first fabricated. Then, a first groove $g_1$ is made by cutting in the through-bore 9*b* in the second support wall Wb at a roller-retaining portion H. To make the first groove $g_1$, a main portion for the first groove $g_1$ is first cut in the inner peripheral surface of the through-bore 9*b* by a groove-making cutter Cg fed in an arcuate shape along the inner periphery of the through-bore 9*b*, as shown in FIG. 4A, and opposite end faces of the groove $g_1$ are then cut by another cutter (not shown) fed in the same direction to provide flat faces f extending in a substantially diametrical direction of the through-bore 9*b*, as shown in FIG. 4B. The reason why the opposite end faces of the first groove $g_1$ are formed into the flat faces f is to ensure that they are properly engaged with flat opposite ends faces of the C-shaped circlip L to provide a satisfactory rotation-preventing effect.

On the other hand, a roller shaft 7 is fabricated at a step different from the step of fabricating the rocker arm body 2. Then, a second groove $g_2$ is cut around the outer periphery of the second end 7*b* of the shaft 7, and the circlip L is fitted into the second groove $g_2$.

Then, a roller R having a large number of needles N temporarily assembled to its inner periphery is inserted into and retained in a clearance between the first and second support walls Wa and Wb of the rocker arm body 2 by use of a second jig (not shown), so that the roller R is coaxial with the through-bores 9*a* and 9*b* in the support walls Wa and Wb. The roller 7 is inserted as left in the retained state with its first end 7*a* turned ahead sequentially into the through-bore 9*b* in the second support wall Wb and into the roller in such a manner that the phases of the first and second grooves $g_1$ and $g_2$ are matched with each other, and the second end 7*b* is fitted into the through-bore 9*b* in the second support wall Wb. In carrying out such fitting the circlip L is forcibly retained in advance by the first jig (not shown) in a resiliently shrunk state in which it has been immersed into the second groove $g_2$. The circlip L is released from the first jig at the time when it has reached the inside of the through-bore 9*b* with the fitting, and then slid within the through-bore 9*b*. When the circlip L reaches a position corresponding to the first groove $g_1$, it is deformed in an expanded manner into the first groove $g_1$ by its resilient restoring force to become a normal set state. Thus, the roller shaft 7 can be integrally fixed to the second support wall Wb (therefore, to the rocker arm body 2). After fixing of the roller shaft 7, the closing wall 7*bw* is secured by welding or the like to the outer surface of the second support wall Wb of the rocker arm 2, particularly, of the first rocker arm $\mathbf{1}_1$.

In the above manner, the axial relative movement and the relative rotation of the roller shaft 7 and the support walls Wa and Wb are inhibited by the C-shaped resilient circlip L which can be engaged with the inner surfaces of the first and second grooves $g_1$ and $g_2$ astride them. Therefore, the roller shaft 7 can be fixed imply to the rocker arm body 2 without special caulking equipment, thereby achieving a corresponding reduction in cost. Moreover, no protrusion for fixing the roller shaft exists on the outer surfaces of the support walls Wa and Wb, whereby the width of the rocker arm (the maximum dimension in a direction of the roller shaft) can be correspondingly decreased, leading to a reduction in size of the rocker arm 1.

In the illustrated embodiment, the roller shaft 7 is formed into a hollow shape for the purpose of providing a reduction in weight of the rocker arm 1. However, even if the roller shaft 7 is of such hollow structure, there is not a possibility that a deformation or a strain is produced in the roller shaft 7, as when the roller shaft 7 is fixed by caulking, and the inner peripheral surface of the roller shaft 7 and the outer peripheral surface of the central portion 7*m* of the roller shaft (the roller-rolling surface) can be formed into a smooth shape. Therefore, the switching pin P can be slid smoothly on the inner peripheral surface of the roller shaft 7. Thus, the switching-over of the valve operating characteristics can be performed precisely, and the roller R can be rotated always smoothly on the roller-rolling surface.

The roller shaft 7 may receive a large struck load from the cam C, and a largest shearing force may act, due to the struck load, particularly on that portion of the roller shaft 7 which corresponds to a boundary between each of the support walls Wa and Wb and the roller R (i.e., a portion in the vicinity of each of the inner end edges $\mathbf{9}a_E$ and $\mathbf{9}b_E$ of the through-bores 9*a* and 9*b* in the support walls Wa and Wb). In the present embodiment, however, the second groove $g_2$ is disposed at a location axially spaced apart from the boundary-correspondence portion and hence, a reduction in strength (specifically, a deformation or a fracture) of the boundary-correspondence portion due to the provision of the groove $g_2$ is inhibited effectively.

Moreover, the switching pin P for changing the valve operating characteristics can be inserted into and removed from those ends of the rocker arm body 2 and the roller shaft 7 in which the first and second grooves $g_1$ and $g_2$ are not provided (therefore, the rigidity of which is not reduced). Therefore, the insertion and the removal of the switching pin P can be performed stably and smoothly. Even in a state in which the switching pin P has been located astride the two roller shafts 7, 7 (i.e., in a state in which the adjacent rocker arm bodies 2, 2 have been connected to each other), as shown in FIG. 2A, the connecting load can be received by the higher-rigidity portion and hence, the strength is increased correspondingly.

Figure 5:
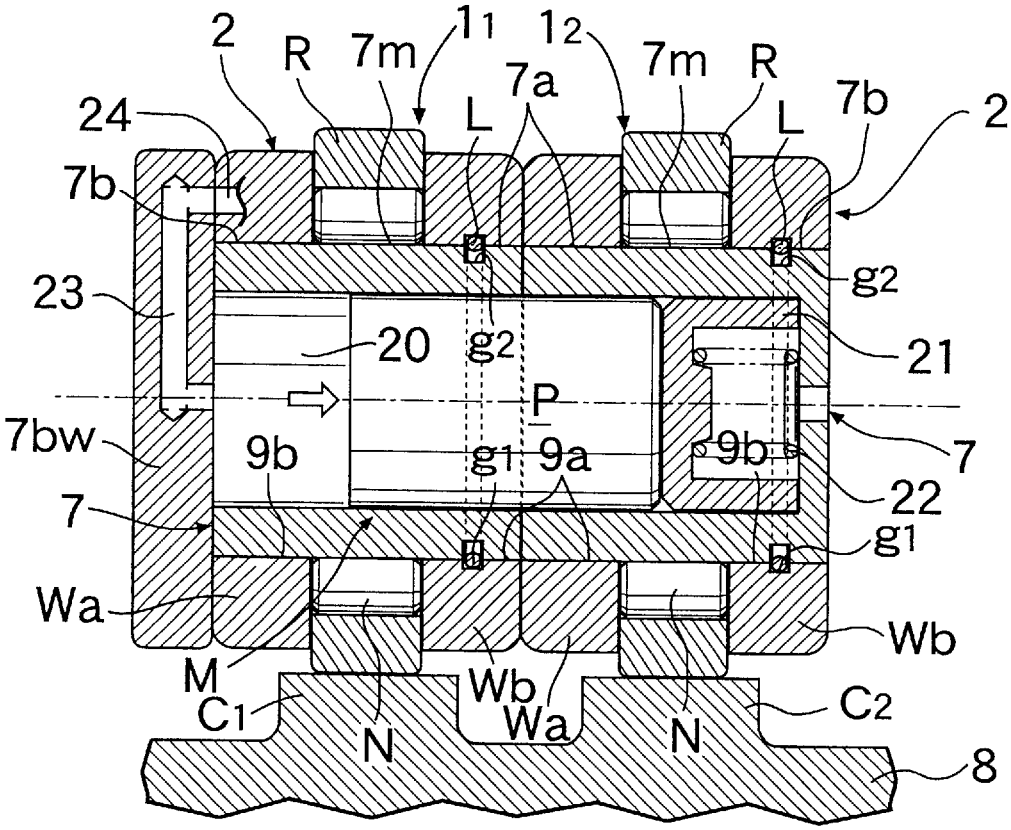
FIG. 5 is a view similar to FIG. 2A, but according to a second embodiment of the present invention.

A second embodiment of the present invention will now be described with reference to FIG. 5. In this embodiment, a closing wall 7*bw* is provided outside one, on which the resilient fastener L is not provided, (the first support wall Wa), of the pair of support walls Wa and Wb of the cam follower body 2 of, as particularly the first rocker arm $\mathbf{1}_1$ to define a working oil chamber 20 between the closing wall 7*bw* and the switching pin P. Therefore, when the roller shaft 7 is inserted into the support walls Wa and Wb from the side opposite to the closing wall 7*bw* (the right side as viewed in FIG. 5) to keep out of the closing wall 7*bw*, the resilient fastener L can be positioned on the side of the inserting opening (i.e., on the side of the second support wall Wb), and the assembling operation can be easily performed without difficulty and without being influenced by the presence of the closing wall 7*bw*. For example, even if the closing wall 7*bw* is secured to the first support wall Wa in advance (i.e., before the insertion of the roller shaft 7), the operation of inserting the roller shaft 7 is not hindered.

A third embodiment of the present invention will now be described with reference to FIGS. 6 to 9. In this embodiment, three rollered rocker arms per cylinder are arranged adjacent one another and swingably carried on a common rocker shaft 3, as illustrated in the first embodiment, so that rollers R of the first, second and third rocker arms $\mathbf{1}_1$, $\mathbf{1}_2$ and $\mathbf{1}_3$ are in contact with three cams (a low-speed cam $C_1$, a high-speed cam $C_2$ and a stopping cam $C_3$ in the illustrated embodiment) integrally arranged side by side on a cam shaft 8. The low-speed cam $C_1$ and the high-speed cam $C_2$ are formed to correspond to the low-speed and high-speed operations of the engine, respectively and moreover, the high-speed cam $C_2$ is formed at a lift amount larger than that of the low-speed cam $C_1$. The stopping cam $C_3$ is used for substantially stopping the corresponding intake valve $V_2$ and has a circular section basically corresponding to base circles of the low-speed and high-speed cams $C_1$ and $C_2$, but has a smaller lobe $Ca_3$ slightly bulged from the base circle, which is provided at its portion corresponding to the lobes $Ca_1$ and $Ca_2$ of the low-speed and high-speed cams $C_1$ and $C_2$.

The first and third rocker arms $\mathbf{1}_1$ and $\mathbf{1}_3$ located on the opposite sides are operatively connected to first and second intake valves $V_1$ and $V_2$ as two engine valves of the same type provided per cylinder. Therefore, the intake valves $V_1$ and $V_2$ are opened and closed in response to the swinging movement of the first and third rocker arms $\mathbf{1}_1$ and $\mathbf{1}_3$.

The engine body E is provided with a lost motion mechanism Lo as a biasing means for normally biasing the second rocker arm $\mathbf{1}_2$ toward the corresponding high-speed cam $C_2$. The lost motion mechanism Lo is comprised of a bottomed cylindrical guide member 51 swingably fitted and supported in a guide hole 50 which opens into an upper portion of the engine body E, and a spring 52 for resiliently biasing the guide member 51 toward the high-speed cam $C_2$. A tip end of the guide member 51 is slidably in pressure contact with a receiving portion 1s integrally formed in a bulged manner on a lower surface of the first support wall Wa of the second rocker arm $\mathbf{1}_2$.

A connection switch-over mechanism M is provided in the first, second and third rocker arms $\mathbf{1}_1$, $\mathbf{1}_2$ and $\mathbf{1}_3$ and is capable of switching-over the connected and disconnected state of these arms in accordance with the operational state of the engine. The connection switch-over mechanism M includes a first switching pin $P_1$ fitted in hollow portions of the roller shafts 7, 7 of the first and second rocker arms $\mathbf{1}_1$ and $\mathbf{1}_2$ for sliding movement astride the hollow portions to enable the first and second rocker arms $\mathbf{1}_1$ and $\mathbf{1}_2$ to be switched over between the connected and disconnected states, a second switching pin $P_1$ fitted in hollow portions of the roller shafts 7, 7 of the second and third rocker arms $\mathbf{1}_2$ and $\mathbf{1}_3$ for sliding movement astride the hollow portions to enable the second and third rocker arms $\mathbf{1}_2$ and $\mathbf{1}_3$ to be switched over between the connected and disconnected states, a movement limiting member 55 slidably fitted within the roller shaft 7 of the third rocker arm $\mathbf{1}_3$ to define retreating limits for the switching pins $P_1$ and $P_2$, and a return spring 56 for biasing the switching pins $P_1$ and $P_2$ and the limiting member 55 in a disconnecting direction (leftwards as viewed in FIG. 6).

A working oil chamber 58 is defined between the an outer roller-supporting wall 57 of the first rocker arm $\mathbf{1}_1$ and the switching pin $P_1$ and is normally in communication with an oil supply passage 60 within the rocker shaft 3 via an oil passage 59 within the first rocker arm $\mathbf{1}_1$. The oil supply passage 60 is capable of being selectively put into communication with any of a hydraulic pressure source and an oil tank (both not shown) in accordance with the operational state of the engine. Therefore, in a state in which the oil supply passage 60 is in communication with the hydraulic pressure source and a high-pressure working oil has been supplied from the hydraulic pressure source to the working oil chamber 58, the switching pins $P_1$ and $P_2$ biased to be retreated by the hydraulic pressure of the working oil are in their connecting states (at their retreating limits) shown in FIG. 9 to integrally connect the rocker arms $\mathbf{1}_1$ to $\mathbf{1}_3$ to one another. On the other hand, in a state hydraulic pressure-released state in which the working oil chamber 58 is in communication with the oil tank, the switching pins $P_1$ and $P_2$ biased to be advanced by the resilient force of the return spring 56 are in their disconnecting states (at their advancing limits) shown in FIG. 6 to disconnect the rocker arms $\mathbf{1}_1$ to $\mathbf{1}_3$ from one another. The function of a pin-switched valve operating characteristic changing mechanism of such a three-rocker type is conventionally well-known and hence, further description thereof is omitted.

Figure 6:
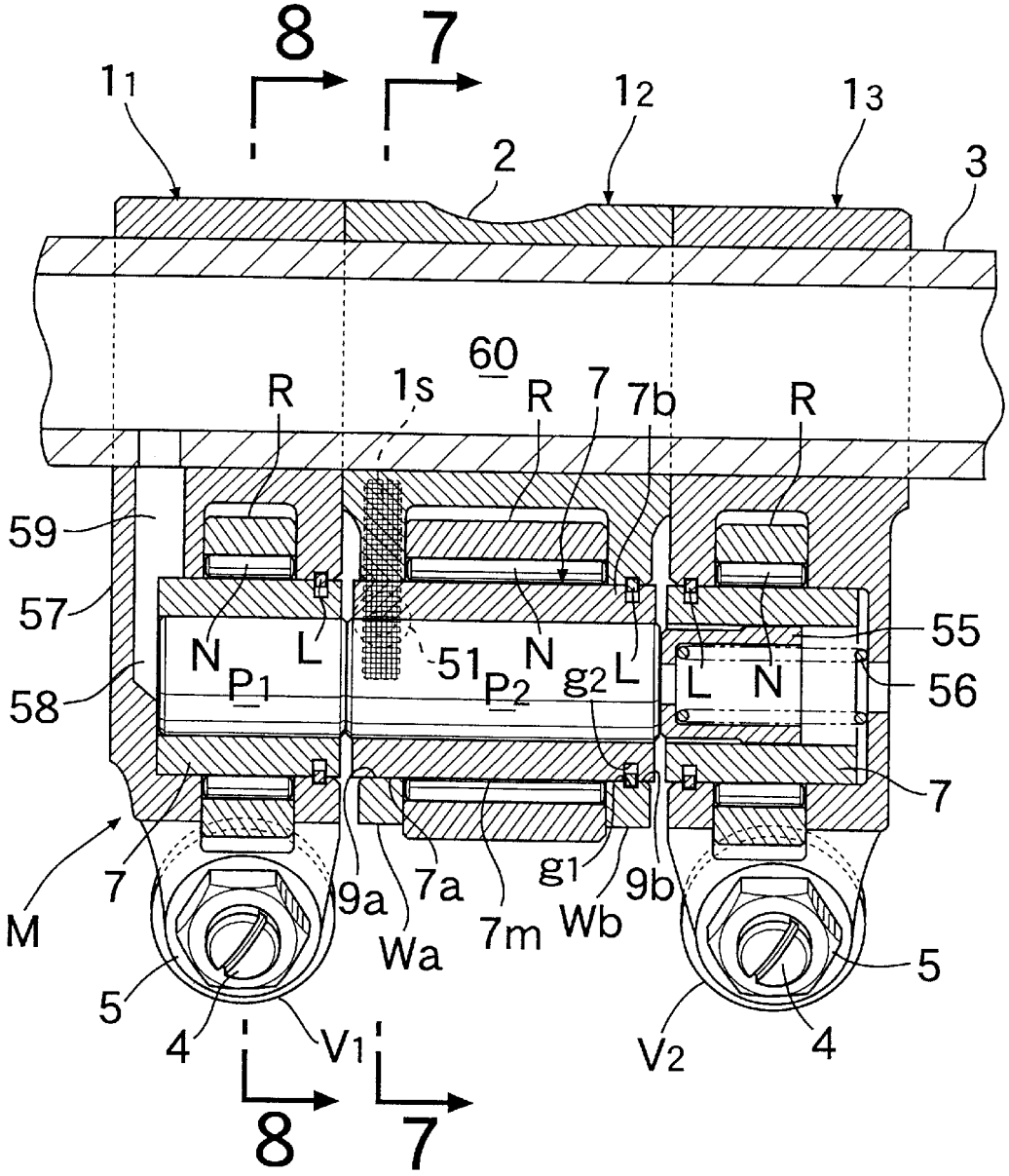
FIG. 6 is a plan sectional view of an essential portion according to a third embodiment of the present invention.
Figure 7:
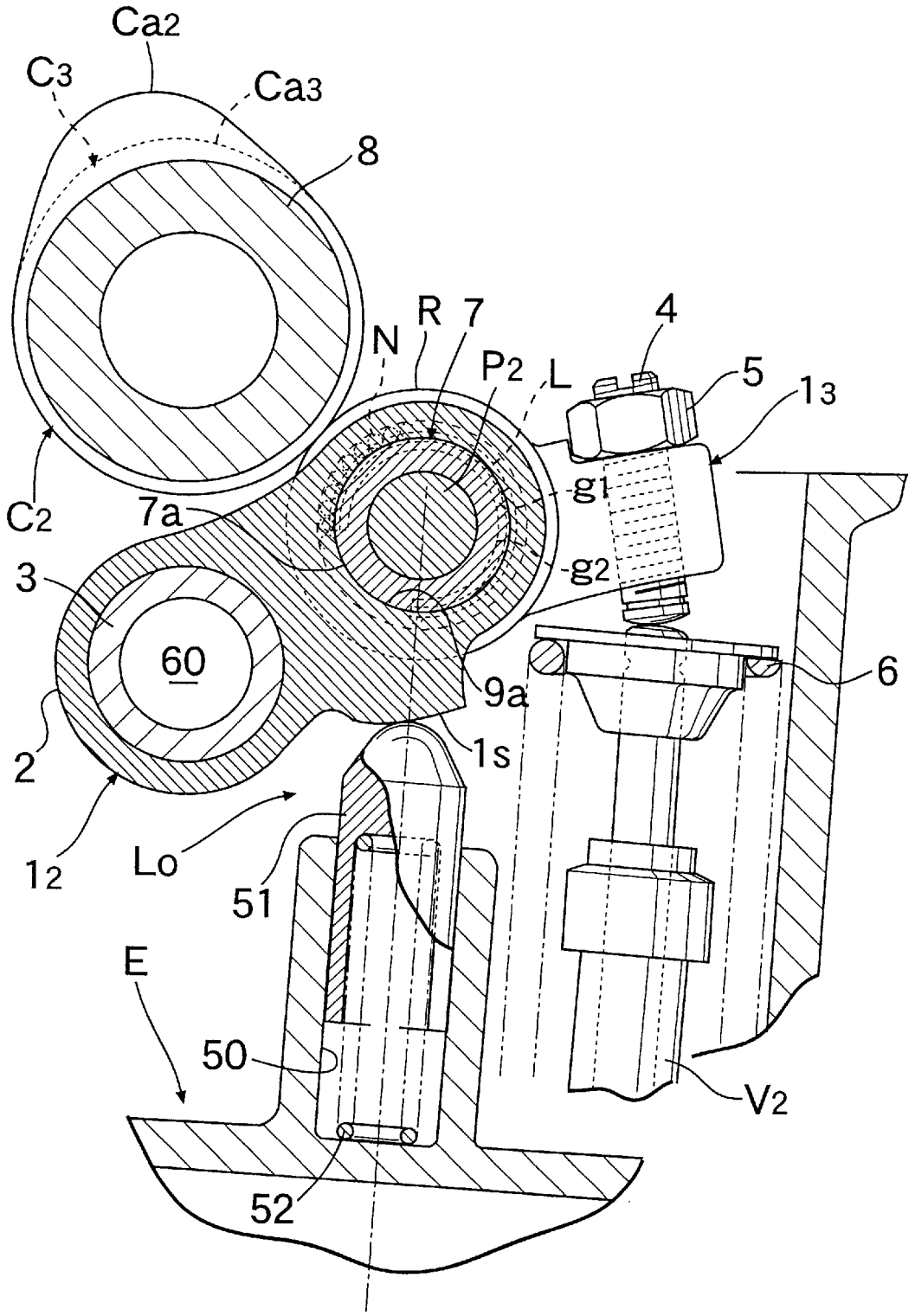
FIG. 7 is a sectional view taken along a line 7—7 in FIG. 6.
Figure 8:
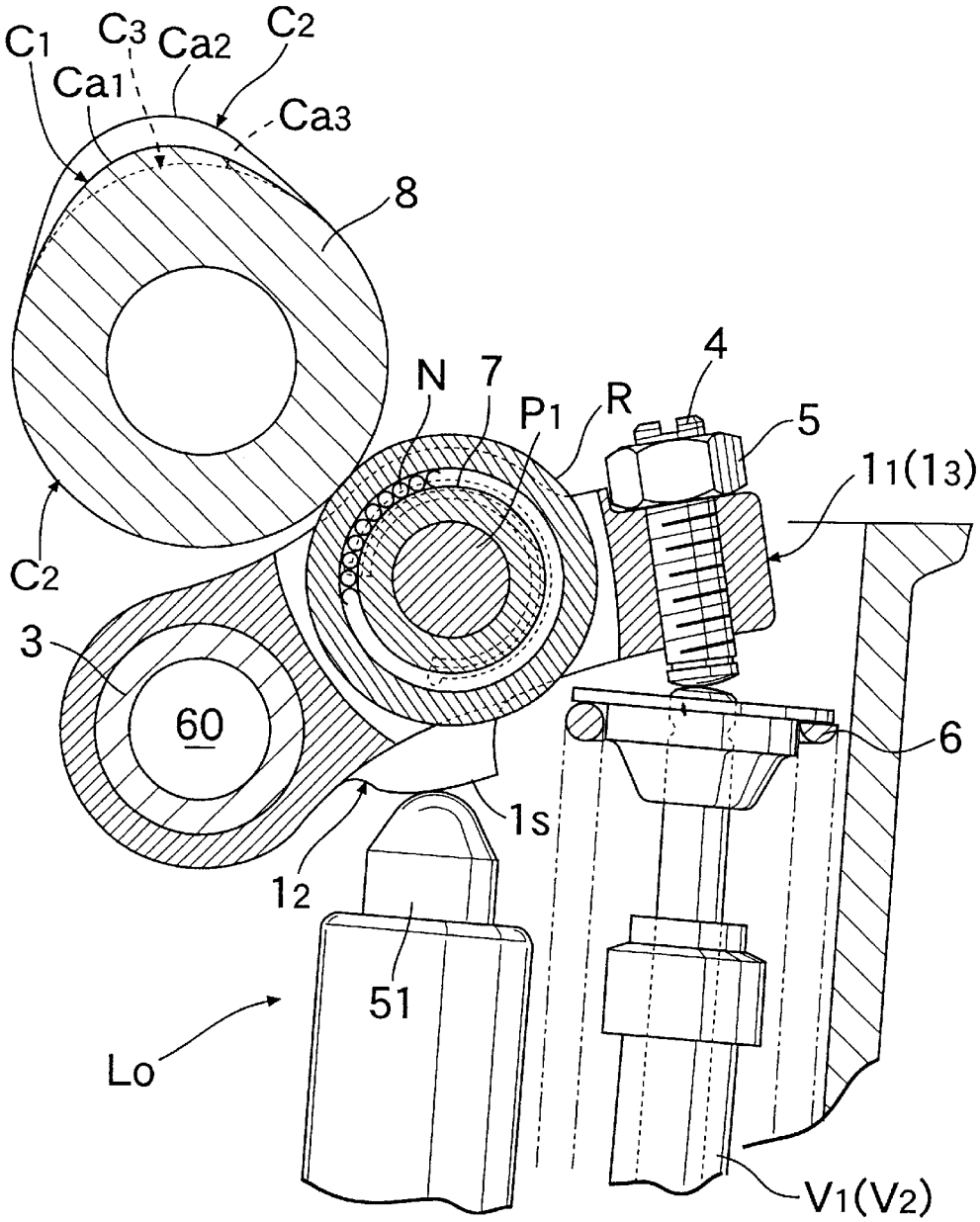
FIG. 8 is a sectional view taken along a line 8—8 in FIG. 6.

During operation of the engine at a low speed, the inside of the working oil chamber 58 is put in a hydraulic pressure-released state, whereby the rocker arms $\mathbf{1}_1$ to $\mathbf{1}_3$ are maintained in their disconnected states shown in FIG. 6. In this state, the first rocker arm $\mathbf{1}_1$ is swung in response to the low-speed cam $C_3$ by the rotation of the cam shaft 8 to open and close the first intake valve $V_1$, while the third rocker arm $\mathbf{1}_3$ is swung extremely slightly (substantially stopped) in response to the stopping cam $C_3$ to bring the second intake valve $V_2$ into a substantially stopped state. Therefore, a swirl fuel-air mixture is supplied efficiently only from one of the intake valve bores into the combustion chamber by opening and closing only the first intake valve $V_1$ in a valve operating mode for a low-speed operation corresponding the shape of the low-speed cam $C_1$. In the low-speed operational state, the second rocker arm $\mathbf{1}_2$ which is not in association with the intake valves $V_1$ and $V_2$ is normally biased toward the high-speed cam $C_2$ by the lost motion mechanism Lo to normally follow the high-speed cam $C_2$ in contact with the latter without looseness.

Figure 9:
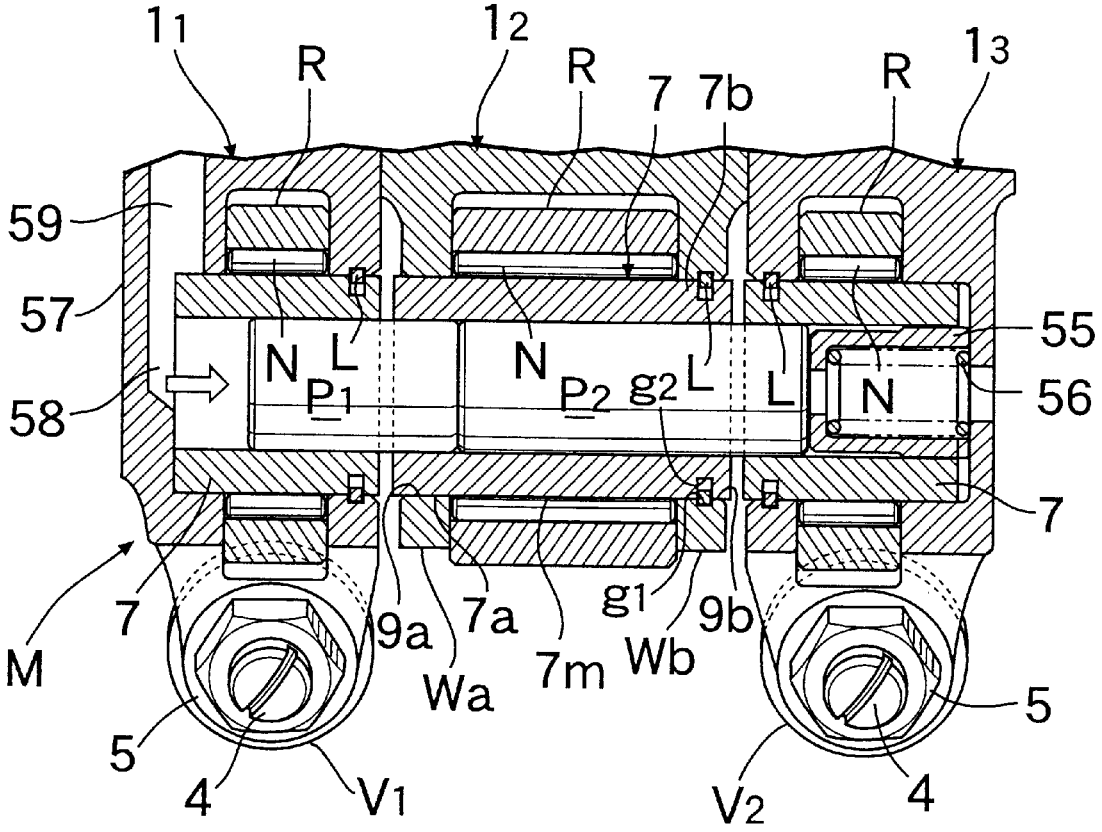
FIG. 9 is a view similar to FIG. 6, but showing a state in which cam followers have been connected to one another.

During operation of the engine at a high speed, the working oil pressure within the working oil chamber 58 has been supplied, and the rocker arms $\mathbf{1}_1$ to $\mathbf{1}_3$ are maintained in their connected states shown in FIG. 9. In this state, the second rocker arm $\mathbf{1}_2$ in contact with the high-speed cam $C_2$ is swung in the largest amount and hence, the first and third rocker arms $\mathbf{1}_1$ and $\mathbf{1}_3$ are swung in unison with the second rocker arm $\mathbf{1}_2$ to open and close the intake valves $V_1$ and $V_2$ in a valve operating mode for a high-speed operation corresponding to the shape of the high-speed cam $C_2$, leading to an increased engine power output.

Even in this embodiment, the fixing of the hollow roller shaft 7 is performed using the C-shaped resilient circlip L and hence, there is not a possibility that a deformation or a strain is produced in the roller shaft 7, as when the roller shaft is fixed by caulking. Therefore, the inner and outer peripheral surfaces of each of the roller shafts 7 are formed into a smooth shape, and a function and an effect similar to those in the first embodiment can be expected.

Particularly, in the second rocker arm $\mathbf{1}_2$, the receiving portion 1*s* of the lost motion mechanism Lo as a biasing means is formed on that portion of the second rocker arm $\mathbf{1}_2$ in which the circlip L is not present, i.e., on the support wall free of the first groove $g_1$ (the first support wall Wa). Therefore, there is not a possibility that the rigidity of the receiving portion 1*s* is reduced due to the presence of the first groove $g_1$ and hence, the sufficient rigidity and strength of the receiving portion is can be ensured without special reinforcement of the receiving portion 1*s*.

Figure 10:
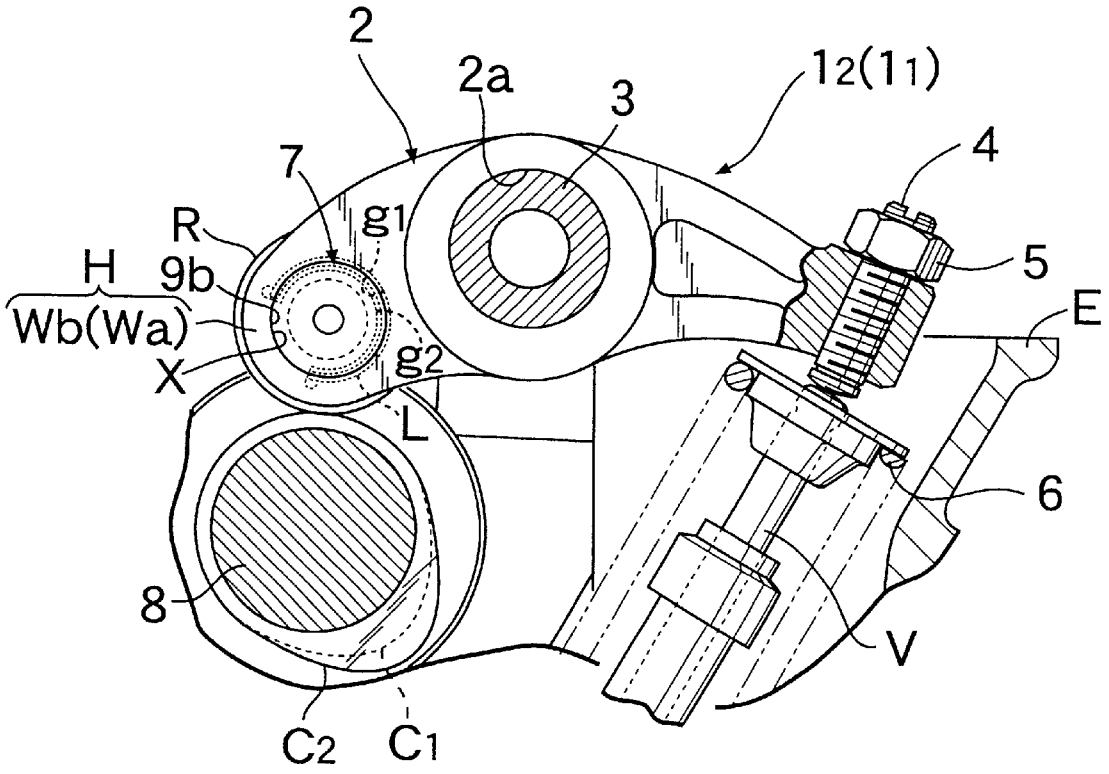
FIGS. 10 and 11 are sectional views similar to FIGS. 1 and 3, respectively, but according to a fourth embodiment of the present invention.
Figure 11:
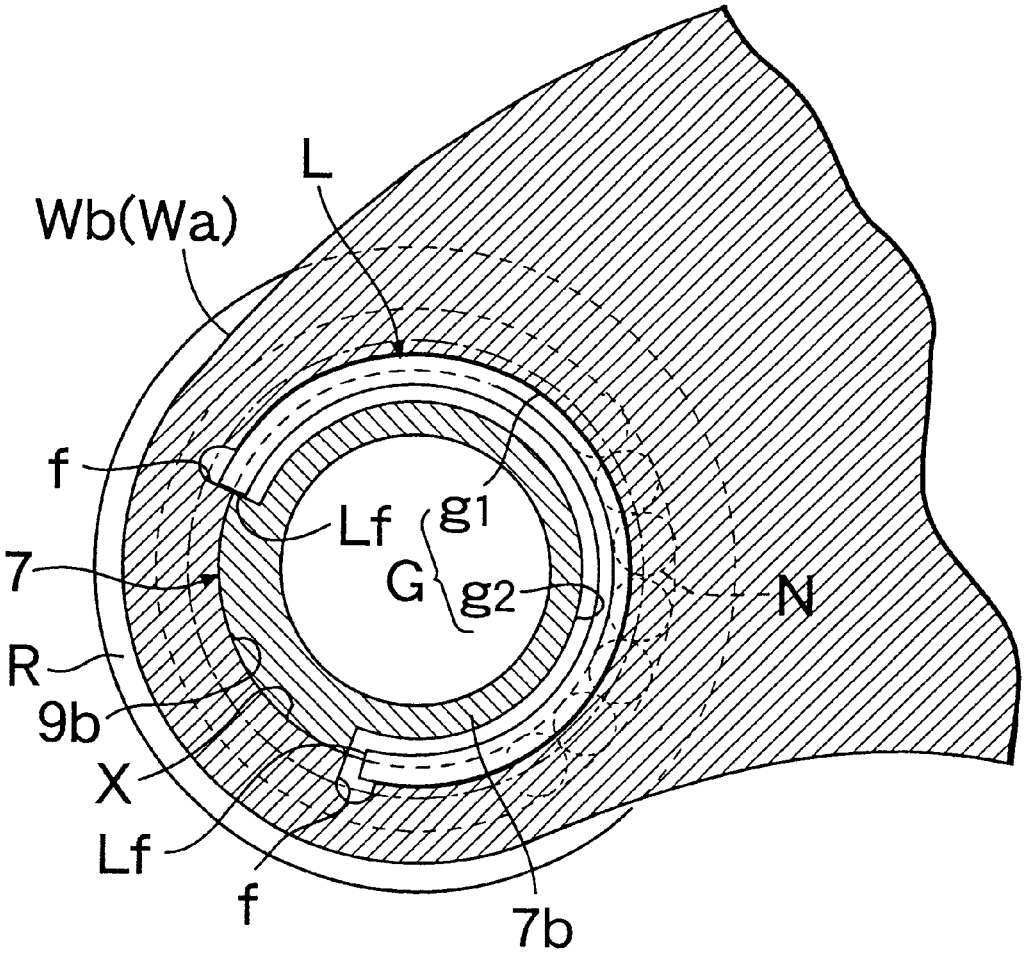
Figure 12:
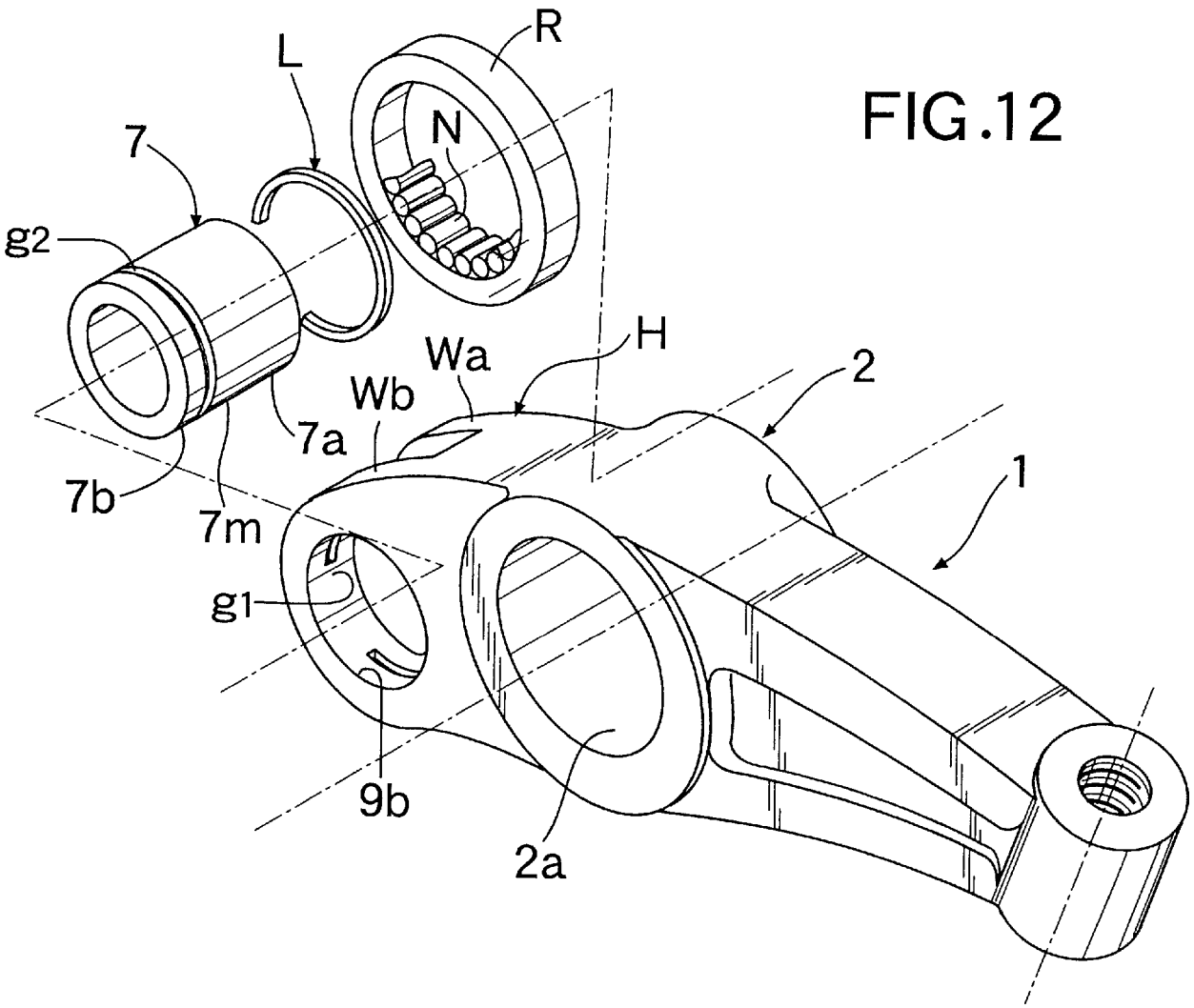
FIG. 12 is an exploded perspective view of a cam follower according to the fourth embodiment.

A fourth embodiment of the present invention is shown in FIGS. 10 to 12. The fourth embodiment is basically the same in structure as the first embodiment, but is different from the first embodiment in respect of that an area X of the inner peripheral portion of the through-bore 9*b* in the second support wall Wb, which is sandwiched between the opposite ends of the first groove $g_1$, is disposed to correspond to the free end (tip end) of the second support wall Wb, wherein an area in the first embodiment corresponding to the area X faces toward the rocker shaft 3. The other construction is similar to that in the first embodiment and hence, components or portions corresponding to those in the first embodiment are designated by the same reference characters as in the first embodiment.

If the area X is disposed to correspond to the free end (tip end) of the second support wall Wb as in the fourth embodiment, the free end of the second support wall Wb need not b beformed specially at a larger thickness, despite the provision =of the first groove $g_1$. Therefore, a reduction in inertial mass of the free end is provided, and the followability of the rocker arm 1 to the cams $C_1$ and $C_2$ can be enhanced correspondingly.

Figure 13:
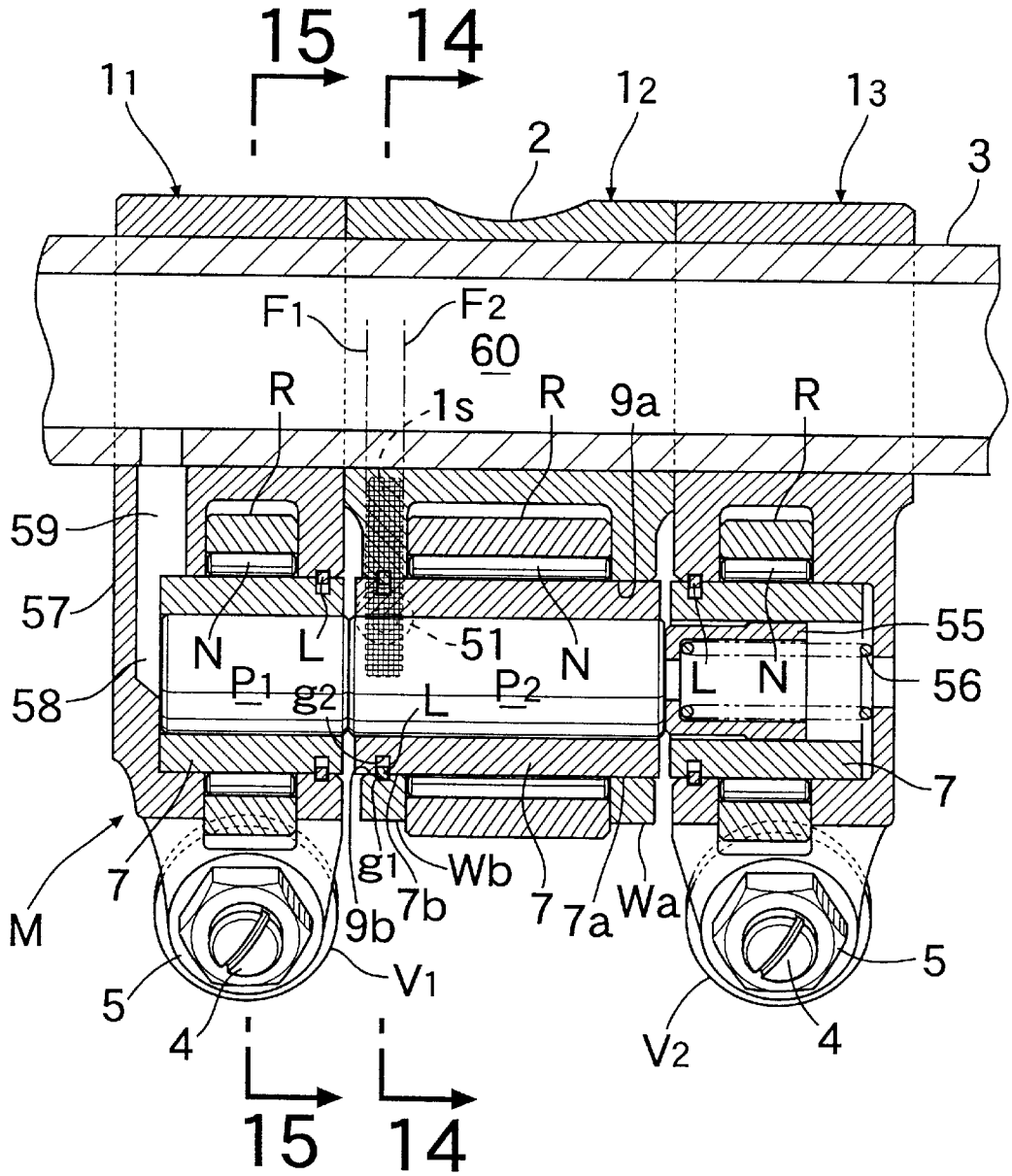
FIG. 13 is a view similar to FIG. 6, but according to a fifth embodiment of the present invention.
Figure 14:
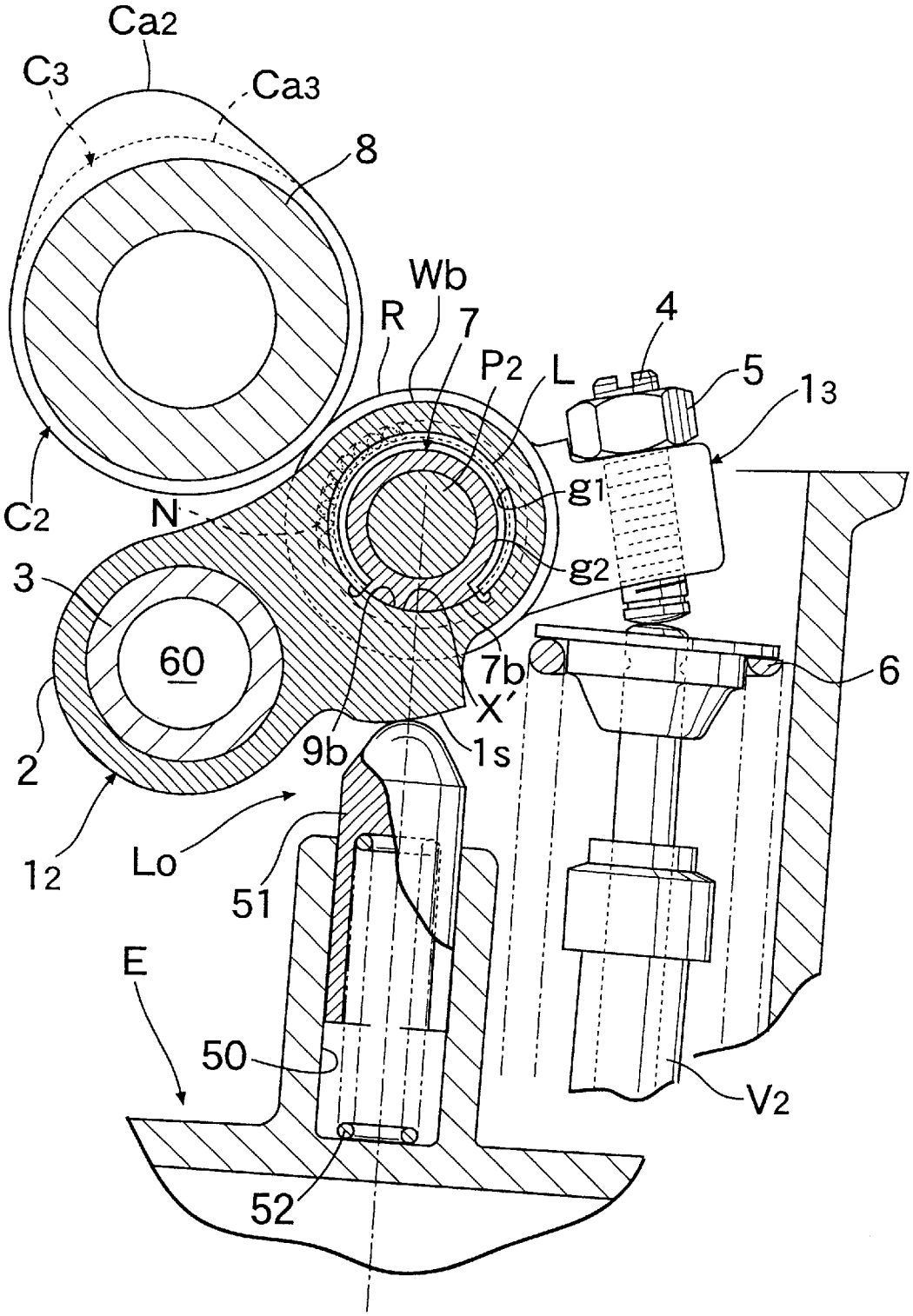
FIG. 14 is a sectional view taken along a line 14—14 in FIG. 13.
Figure 15:
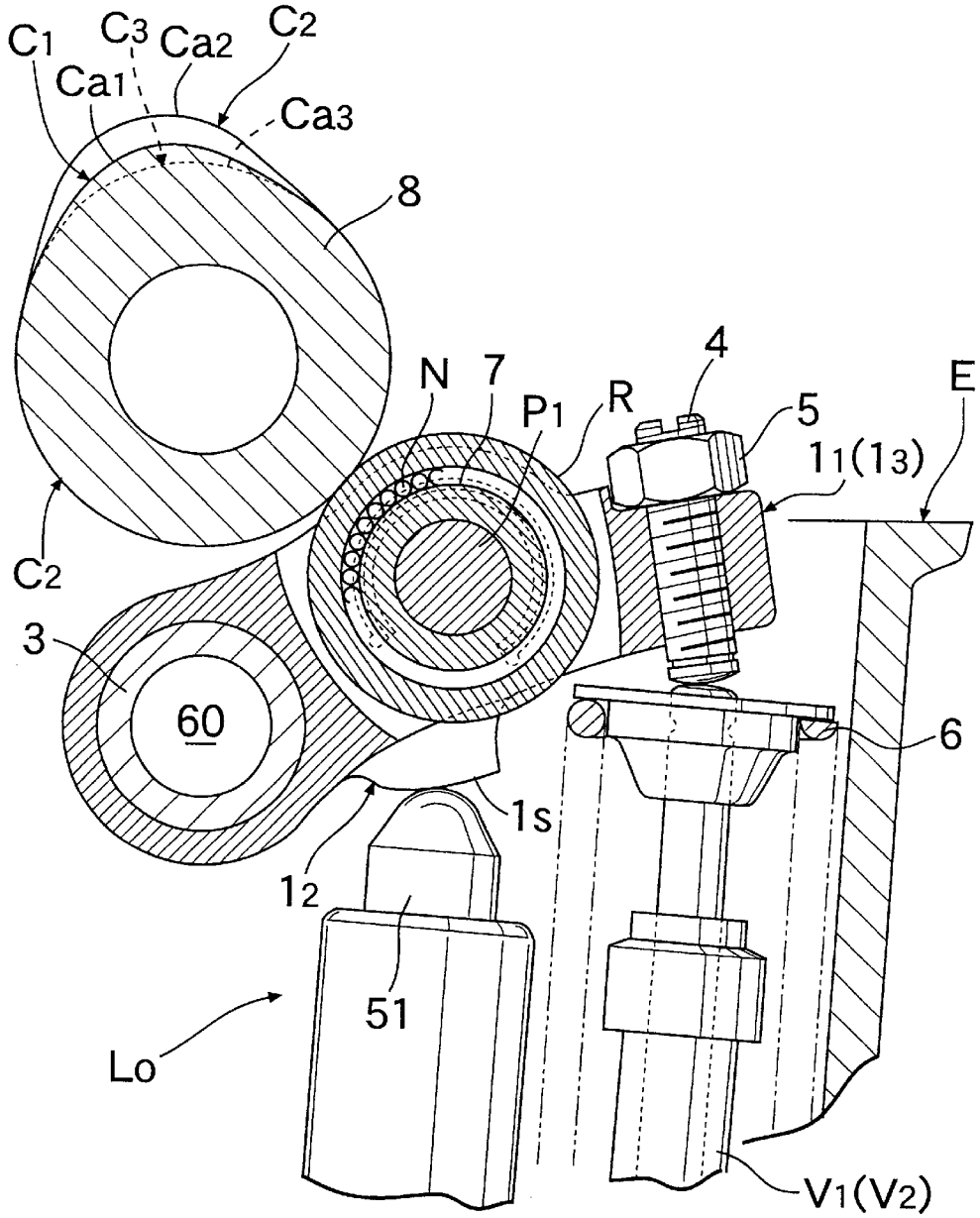
FIG. 15 is a sectional view taken along a line 15—15 in FIG. 13.

A fifth embodiment of the present invention is shown in FIGS. 13 to 15. The fifth embodiment is basically the same in structure as the third embodiment, but is different from the first embodiment in respect of that a receiving portion Is for the biasing means (the lost motion mechanism Lo) is provided on the second support wall Wb, particularly in the second rocker arm $\mathbf{1}_2$, and an area X' of the inner peripheral portion of the through-bore 9*b* in the second support wall Wb, which is sandwiched between the opposite ends of the first groove $g_1$, is disposed to correspond to the receiving portion 1*s*. The other construction is the same as in the first embodiment and hence, components or portions corresponding to those in the first embodiment are designated by the same reference characters as in the first embodiment.

If the area X' is disposed to correspond to the receiving portion 1s provided on the second support wall Wb as in the fifth embodiment, the reduction in rigidity of the receiving portion 1*s* in the support wall Wb can be avoided to the utmost, even if the first groove $g_1$ is defined in the inner peripheral portion of the through-bore 9*b* in the support wall Wb, thereby providing reductions in size and weight of the rocker arm $\mathbf{1}_2$.

In the fifth embodiment, as can be seen from FIGS. 13 and 14, a portion of the second support wall Wb opposed to the biasing means (the lost motion mechanism Lo) is formed thicker in a diametrical direction of the roller shaft, so that the outer surface thereof protrudes toward the biasing means, such thicker portion being used as the receiving portion 1*s*, and the first groove $g_1$ is located between two flat faces $F_1$ and $F_2$ passing through the opposite sides of the receiving portion 1*s* and perpendicular to an axis of the roller shaft. Therefore, the biasing force of the biasing means can be received stably by the thicker receiving portion 1*s*. Even if the first groove $g_1$ is formed in any peripheral position on the inner peripheral surface of the through-bore 9*b* in one of the support walls Wb, the reduction in rigidity due to the formation of the groove can be compensated for effectively by the thicker receiving portion 1*s*.

Figure 16:
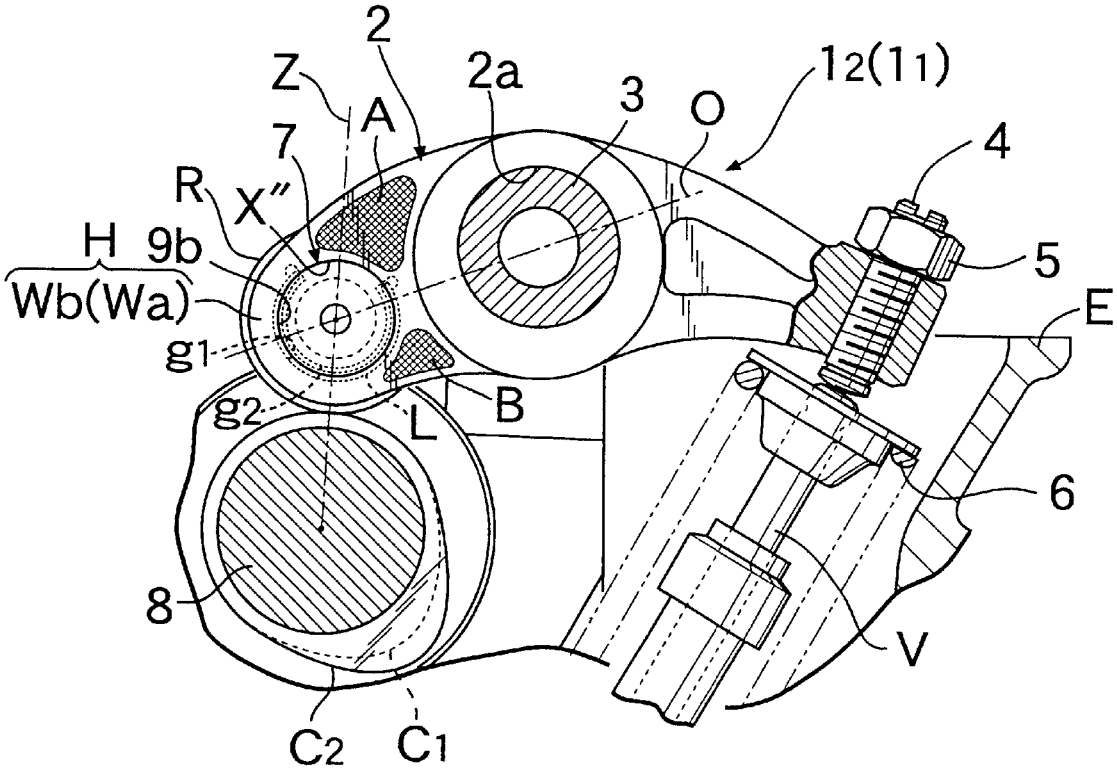
FIG. 16 is a sectional view similar to FIG. 1, but according to a sixth embodiment of the present invention.

A sixth embodiment of the present invention is shown in FIG. 16. The sixth embodiment is basically the same in structure as the first embodiment, but is different from the first embodiment in respect of that an area X" of the inner peripheral portion of the through-bore 9*b* in the second support wall Wb, which is sandwiched between the opposite ends of the first groove $g_1$, is disposed to correspond to that portion A of the .rocker arm body 2 to which a compressing load is applied during lifting operation provided by the cams $C_1$ and $C_2$. The other construction is the same as in the first embodiment and hence, components or portions corresponding to those in the first embodiment are designated by the same reference characters as in the first embodiment.

When roller-side half of the rocker arm 1 is lifted in a pushed-up manner by the cams $C_1$ and $C_2$, that portion A of the rocker arm body 2 which is sandwiched between the roller shaft 7 and the rocker shaft 3 in front of a line O interconnecting axes of the rocker shaft 7 and the rocker shaft 3 in a lifting direction (above as viewed in FIG. 16) has a relatively large burden of load, because mainly a compressing load is applied to such portion A. On the other hand, a portion B sandwiched between the roller shaft 7 and the rocker shaft 3 at the rear of the connecting line O (below as viewed in FIG. 16) has a relatively smaller burden of load, because mainly a tensile load is applied to the portion B. Therefore, if that area X" of the inner peripheral portion of the through-bore 9*b* in the second support wall Wb, which is sandwiched between the opposite ends of the first groove $g_1$, is disposed to correspond to the compressing load-applied portion A as in the sixth embodiment, the wall thickness of the portion receiving a larger compressing load during the lifting operation provided by the cams $C_1$ and $C_2$, can be ensured at a large value to the utmost and hence, the compressing load can be received stably, despite the provision of the first groove $g_1$.

In the sixth embodiment shown in FIG. 16, a phantom plane Z interconnecting the axis of the roller shaft 7 and rotational axes of the cams $C_1$ and $C_2$ is disposed to pass through that area X" of the inner peripheral portion of the through-bore 9*b* in the second support wall Wb, which is sandwiched between the opposite ends of the first groove $g_1$. During operation of the engine, a struck load is applied substantially along the phantom plane Z from the cams $C_1$ and $C_2$ through the roller R to the roller shaft 7 (the through-bore 9*b* in the support wall Wb), and that site of the cam follower body 2 which is closer to the phantom plane Z, e.g., that site of the inner peripheral portion of each of the through-bores 9*a* and 9*b* in the support walls Wa and Wb which is in the vicinity of the phantom plane Z, is a stress-concentrated site. However, the first groove $g_1$ can be defined to keep out of the stress-concentrated site, because the area X" passes through the phantom plane Z, as described above. Therefore, the reduction in rigidity and strength of such site is inhibited despite the provision of the first groove $g_1$, and this is particularly convenient when the cam follower body 2 is formed of an aluminum-based metal material. In the illustrated embodiment, the phantom plane Z passes a central portion of the area X" and hence, the reduction in rigidity and strength of the stress-concentrated site is inhibited further effectively.

Figures 17, 17A:
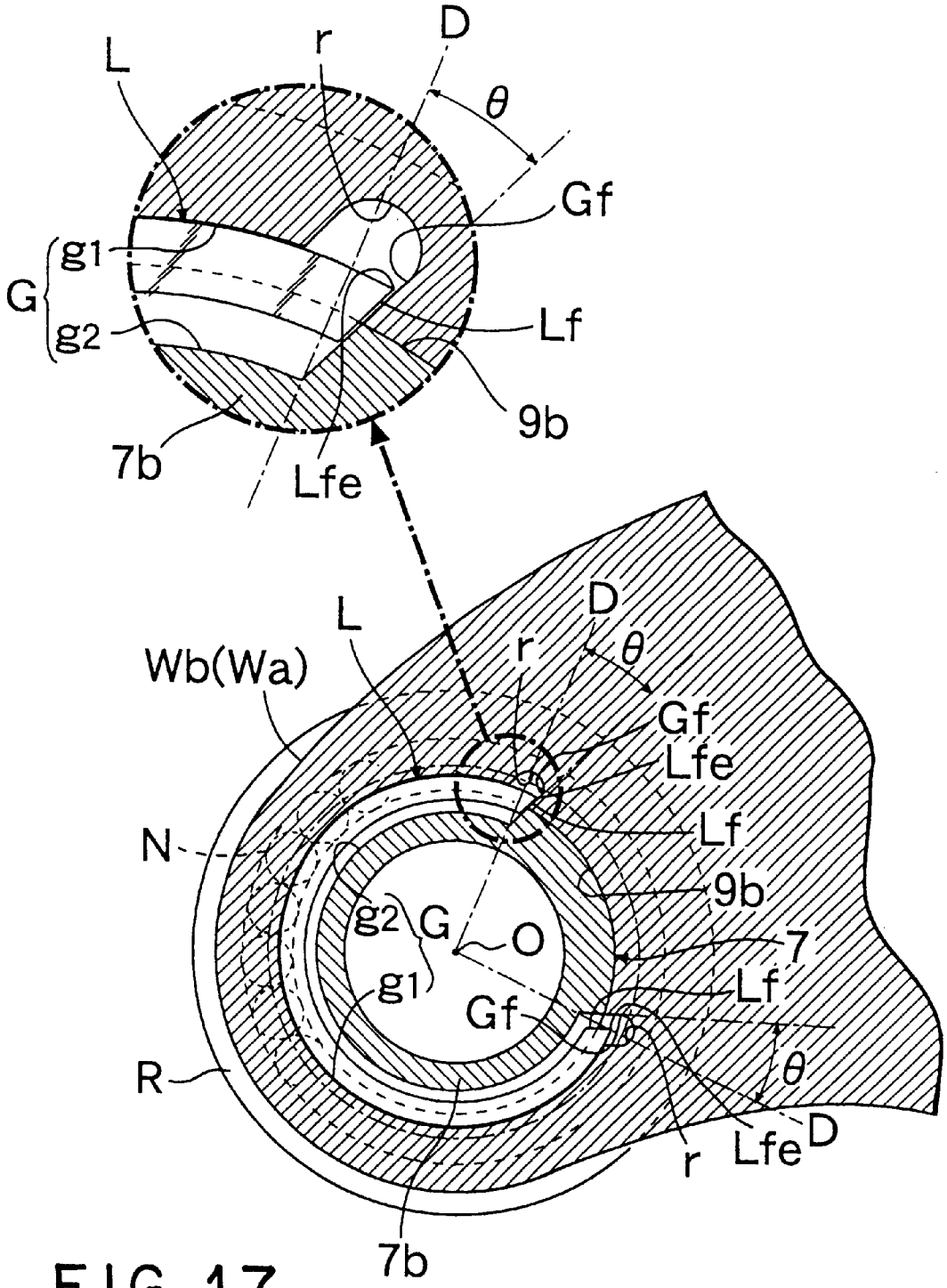
FIG. 17 is a sectional view similar to FIG. 3, but according to a seventh embodiment of the present invention.

A seventh embodiment of the present invention is shown in FIG. 17. The seventh embodiment is basically the same in structure as the first embodiment, but entire opposite end faces Lf of a circlip L are formed flat. Moreover, the end faces Lf are inclined at a predetermined angle θ to approach each other to a more extent at an outer location in a diametrical direction of a circlip L with respect to a phantom plane D extending radiately from an axis O of the roller shaft 7 toward the end of the circlip L. On the other hand, opposite inner end faces Gf of the hollow portion G opposed to the end faces Lf (i.e., opposite inner end faces of the first and second grooves $g_1$ and $g_2$) are formed flat faces (likewise inclined with respect to the phantom plane D) parallel to the opposite end faces Lf of the circlip L, respectively. Thus, each of the end faces of the circlip L and each of the inner end faces Gf of the hollow portion G opposed in parallel to the end faces Lf can be brought into face contact with each other with a sufficient wide contact area and hence, are brought into proper engagement with each other to exhibit a sufficient rotation-preventing effect. Moreover, the surface pressure of contact between the end faces is alleviated effectively, which is extremely effective for a reduction in wear of the contact portions (i.e., the end faces Lf of the circlip and the inner end faces of the hollow portion G).

Moreover, each of the inner end faces Gf of the hollow portion G is extended long diametrically outwards past an outer peripheral edge portion Lfe of that end face Lf of the circlip L, which is opposed to the inner end face Gf. Such extension end is smoothly connected to an end edge of an arcuate groove r defined in a depressed manner in a bottom surface of the end of the first groove $g_1$. Thus, a V-shaped recess corresponding to the edge portion Lfe on the outer peripheral side of the end face Lf of the circlip L (such a recess is liable to be a starting point for concentration of a stress) is not defined in the inner end face of the first groove $g_1$. Therefore, it is possible to effectively prevent the generation of fissures and cracks in the inner end face of the first groove $g_1$ due to the abutment of the inner end face against the edge portion Lfe.

Figure 18B:
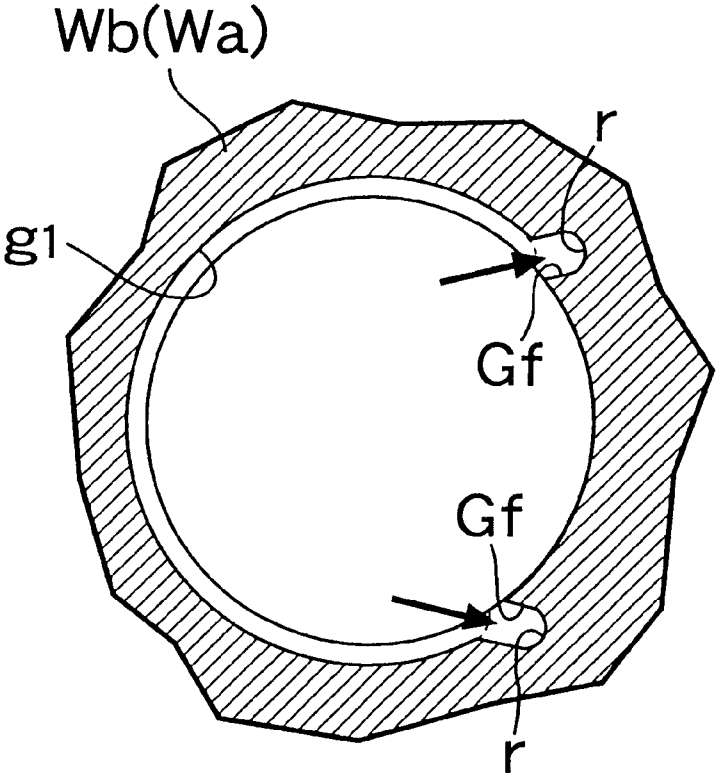
FIG. 18 is a view similar to FIG. 4.
Figure 18A:
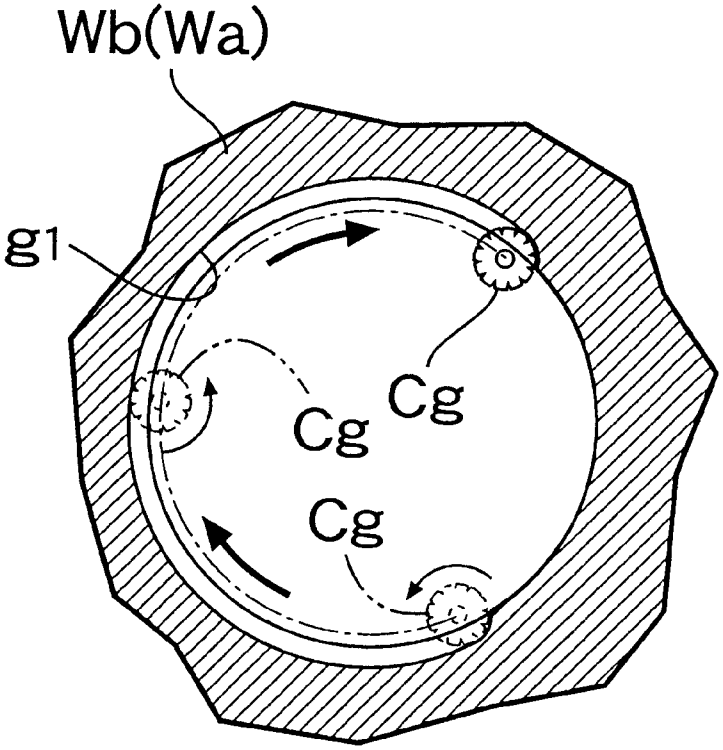
Figures 19, 19A:
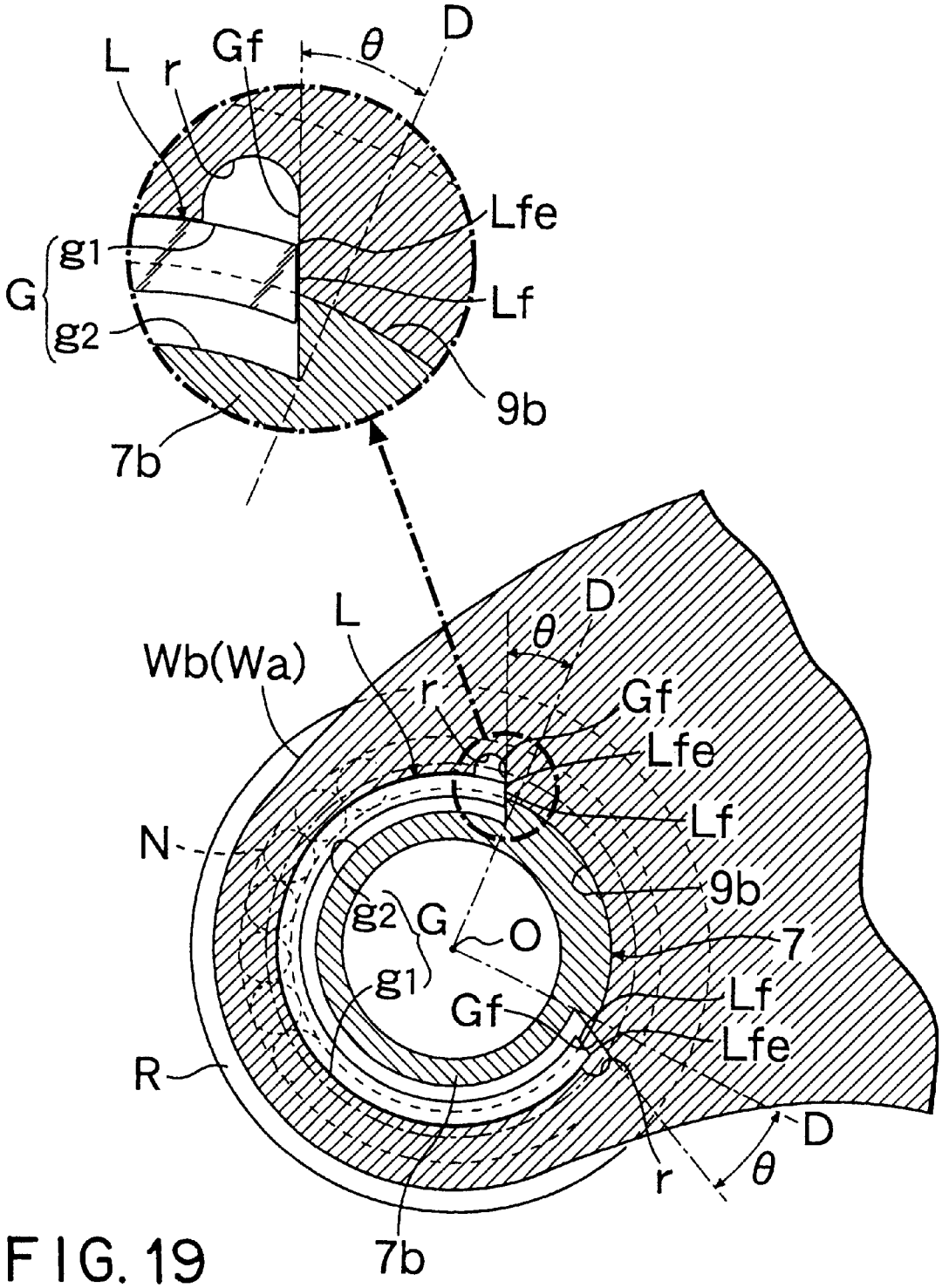
FIG. 19 is a sectional view similar to FIG. 17, but according to an eighth embodiment of the present invention.

A step of cutting the first groove $g_1$ in the through-bore in the second support wall Wb in the rocker arm body 2 having the above-described structure is similar to that in the first embodiment (see FIG. 4). However, when the opposite inner end faces Gf of the groove $g_1$ is to be cut by a cutter (not shown) such as an end mill, as shown in FIG. 18B, the direction of feeding the cutter is set, so that the opposite inner end faces Gf are formed into flat faces inclined at only a predetermined angle θ with respect to the phantom plane D.

The other construction is similar to that in the first embodiment and hence, components or portions corresponding to those in the first embodiment are designated by the same reference characters as in the first embodiment.

An eighth embodiment of the present invention is shown in FIG. 9. This embodiment has an arrangement similar to that in the seventh embodiment, except that the end faces Lf of a circlip L as a resilient fastener are inclined in a direction opposite to that in the seventh embodiment (i.e., at only a predetermined angle θ to become farther from each other at an outer location in a diametrical direction of the circlip L with respect to the phantom plane D). In the eighth embodiment, an effect similar to that in the seventh embodiment can be expected.

In each of the above-described embodiment, a metal material for forming the roller shaft 7 is selected, so that the roller shaft 7 itself has sufficient rigidity and strength. However, in place of, or in addition to the selection of such a material, at least a portion of the roller shaft 7 may be subjected to a special hardening treatment such as a high-frequency hardening and carburizing hardening, as shown in FIGS. 20 to 22.

Figure 20:
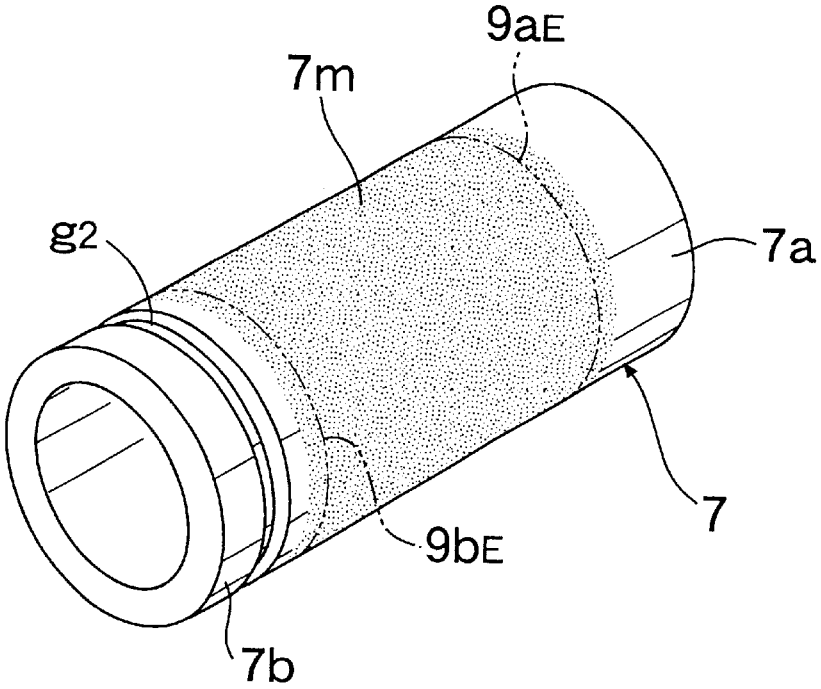
FIG. 20 is a perspective view of a first modification to the roller shaft.

For example, that area of the outer peripheral surface of the roller shaft 7 shown in FIG. 20, which extends from its central needle-rolling face 7*m* to its outer area past inner end edges $9a_E$ and $9b_E$ of the through-bores 9*a* and 9*b*, has been subjected to a hardening treatment. The wear of the needle-rolling face 7*m* can be reduced, and the roller can be rolled smoothly on the rolling face over a long period of time. Moreover, that portion of the outer periphery of the roller shaft 7 receiving a larger struck load (shearing load)from the cam applied thereto, which is in the vicinity of the boundary between the support wall Wa and Wb and the roller R (i.e., in the vicinity of the inner end edges $9a_E$ and $9b_E$ of the through-bores), can be reinforced effectively and hence, the deformation and fracture of the roller shaft 7 due to the shearing load can be prevented effectively. The hardening treatment is stopped at a location short of the second groove $g_2$ as in the example illustrated in FIG. 20, the processing of the second groove $g_2$ can be carried out simply and quickly without being obstructed by a hardened face having a high hardness.

Figure 21:
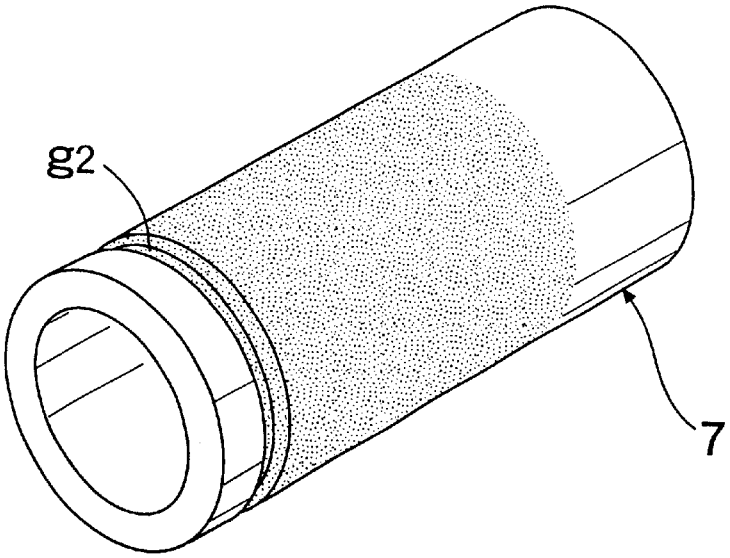
FIG. 21 is a perspective view of a second modification to the roller shaft.

In a roller shaft 7 shown in FIG. 21, the inner surface of the second groove $g_2$ in the outer peripheral surface of the roller shaft 7 (and even the needle rolling face in the illustrated embodiment) has been subjected to a special hardening treatment such as a high-frequency hardening and a carburizing hardening. In this case, the wear of the inner surface of the groove $g_2$ due to the vibration or sliding movement of the resilient fastener L within the second groove $g_2$ is reduced effectively, and a slip-off effect provided by the fastener L is maintained well over a long period of time.

Figure 22:
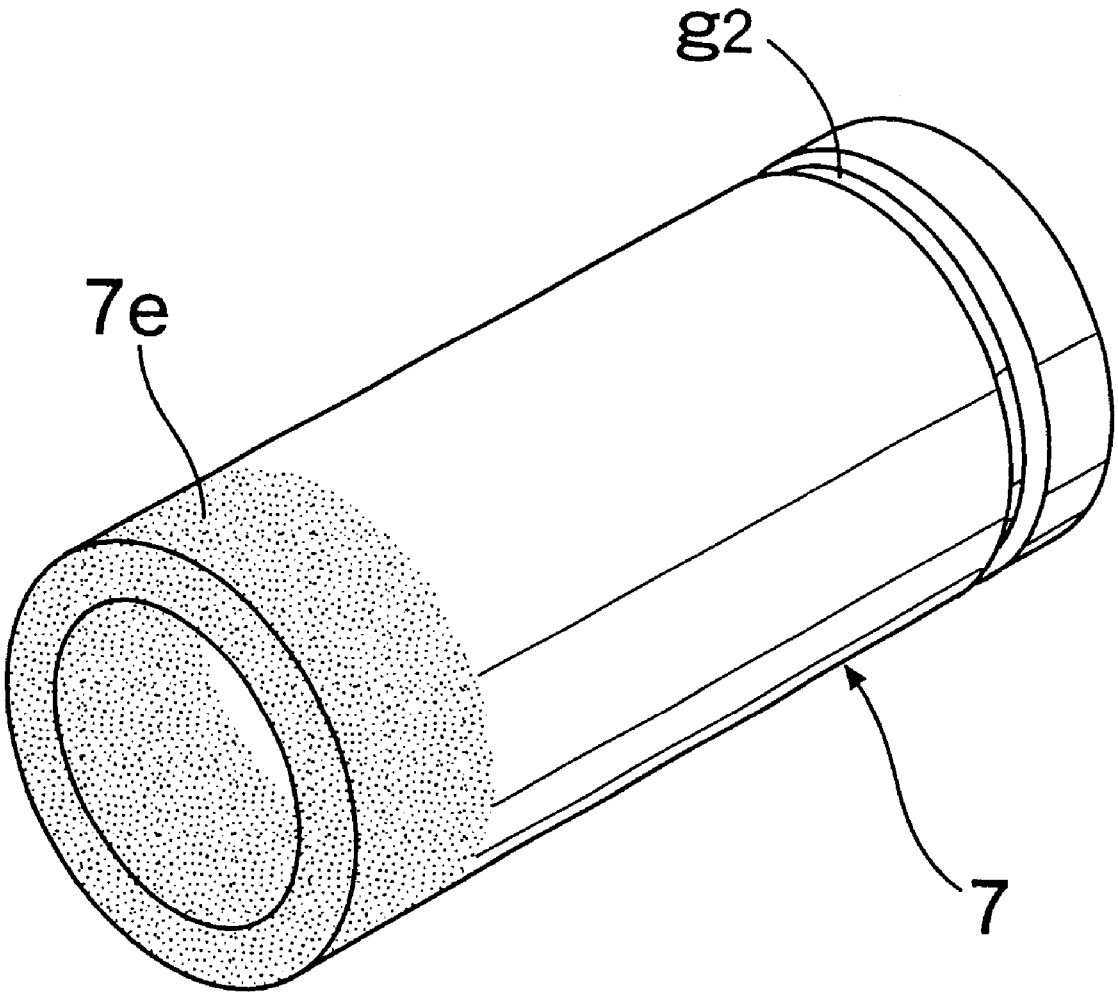
FIG. 22 is a perspective view of a third modification to the roller shaft.

In a hollow roller shaft 7 shown in FIG. 22, an end of the shaft 7 into and from which the switching pin ($P_1$, $P_2$) is inserted and removed, has been specially hardened by a high-frequency hardening a carburizing hardening or the like. In this case, the wear of the roller shaft end 7*e* due to the delivery of the switching pin ($P_1$, $P_2$) between the roller shafts 7 of the adjacent cam followers is reduced.

In each of the above-described embodiments, the rocker arm body 2 as the cam follower body can be formed of any metal material enabling a required rigidity and strength to be ensured, such as an iron-based metal material, an aluminum-based metal material and the like. Particularly, the formation of the rocker arm body from an aluminum-based metal material can largely contributes to a reduction in weight of the rocker arm and moreover, a reduction in inertial mass. Of course, an aluminum alloy material and an aluminum material are included in the aluminum-based metal material.

Although the embodiments of the present invention have been described above, it will be understood that the present invention is not limited to the above-described embodiments, and various modifications may be made with departing from the spirit and scope of the invention defined in claims. For example, in the embodiments, the circlip L as the resilient fastener is mounted in the C-shaped groove $g_1$, $g_2$ having the shape corresponding to the circlip, so that not only the axial relative movement but also the relative rotation of the roller shaft 7 relative to the support walls Wa and Wb can be limited. In the first to third embodiments, the groove $g_1$, $g_2$ may be endless annular in shape, so that only the axial relative movement of the roller shaft 7 may be limited.

In addition, the roller shaft 7 is formed into the hollow cylindrical shape in the embodiments, but in the second feature (claim 17) of the present invention, the roller shaft 7 may be formed into a solid columnar shape. In this case, the switching pin of the connection switch-over mechanism M may be formed so that it can be slid outside the roller shaft 7. Additionally, the direction of sliding movement of the switching pin may be parallel or not parallel to the roller shaft.

Further, the valve operating system shown in each of the first, second, fourth, seventh and eighth embodiments is designed, so that the intake valves $V_1$ and $V_2$ are operatively connected to the two cam followers $\mathbf{1}_1$ and $\mathbf{1}_2$, whereby the valve operating characteristics for the valves $V_1$ and $V_2$ may be switched over between an individual operating mode corresponding to the two cams $C_1$ and $C_2$ and a common operating mode corresponding to the high-lift cam $C_2$. Alternatively, the intake valve V may be operatively connected to only one of the two cam followers $\mathbf{1}_1$ and $\mathbf{1}_2$, so that the valve operating characteristic may be switched over between an operating mode suitable for the high-speed operation and an operating mode suitable for the low-speed operation. The second intake valve $V_2$ is stopped during operation of the engine at the low speed in the third and fifth embodiments, but the second intake valve $V_2$ may be opened and closed in the valve operating mode corresponding to the low-speed operation without being stopped. In this case, the cam corresponding to the third rocker arm $\mathbf{1}_3$ may be changed from the stopping cam $C_2$ to the low-speed cam.

In each of the above-described embodiments, the present invention is carried out for the intake valves $V_1$ to $V_3$ as the engine valves, but in place of, or in addition to this arrangement, the present invention may be carried out for exhaust valves as engine valves.

Further, the valve operating system shown in each of the embodiments is designed, so that the circlip L as the resilient fastener is brought into engagement into the first groove $g_1$ in the through-bore 9*b* in the support wall Wb by inserting the roller shaft 7 into the through-bore 9*b* in the support wall Wb in the state in which the circlip L has been resiliently deformed in the shrunk manner in the second groove $g_2$ in the roller shaft 7. According to the present invention, however, the C-shaped resilient circlip L may be brought into engagement into the second groove $g_2$ in the roller shaft 7 by inserting the roller shaft 7 into the through-bore 9*b* in the support wall Wb in the state in which the C-shaped resilient circlip L has been resiliently deformed in the shrunk manner in the first groove $g_1$ of the through-bore 9*b* in the support wall Wb.

Further, the valve operating system shown in each of the seventh and eighth embodiments is designed, so that the directions of inclination of the opposite end faces Lf of the circlip L as the resilient fastener with respect to the phantom plane D are opposite from each other. According to the present invention, however, the directions of inclination of the opposite end faces Lf may be the same as each other.

What is claimed is:

1. A valve operating system for an internal combustion engine, comprising at least two rollered cam followers arranged adjacent each other and having a rollers put in contact with a plurality of cams, at least one of the cam followers being operatively connected to an engine valve, so that the valve operating characteristic of said engine valve can be changed by moving a switching pin mounted in adjacent one of said cam followers for sliding movement astride the adjacent cam followers, thereby enabling connected and disconnected states of the cam followers to be switched over from one to another, wherein each of said cam followers comprises a cam follower body having a pair of support walls integrally provided thereon and arranged in parallel to sandwich the roller therebetween, and a hollow roller shaft which is fitted and supported at outer peripheries of opposite ends thereof in through-bores in said support walls, said roller shaft having the roller rotatably carried at an intermediate portion thereof; and said system further includes a first groove defined in an inner peripheral surface of the through-bore in one of the support walls to extend in a circumferential direction of the through-bore, a second groove defined in an outer peripheral surface of the roller shaft at one end thereof corresponding to the first groove, and a C-shaped resilient fastener mounted in the first and second grooves and capable of engaging with inner surfaces of said grooves astride the grooves to limit an axial relative movement of said roller shaft and said support walls, said switching pin being slidably fitted to Inner peripheral surfaces of said roller shafts of sa id adjacent cam followers.

2. A valve operating system for an internal combustion engine according to claim 1, further Including a closing wall which is provided outside the other support wall in one cam follower to define a working oil chamber between said closing wall and said switching pin.

3. A valve operating system for an internal combustion engine according to claim 1, wherein said roller is carried on the outer periphery of said roller shaft through needles, and that area of the outer peripheral surface of said roller shaft, which extends from a central needle-rolling face to an outer area past inner end edges of the through-bores, has been subjected at least to a hardening treatment.

4. A valve operating system for an internal combustion engine according to claim 1, wherein the inner surface of said second groove in the outer peripheral surface of said roller shaft has been subjected to a hardening treatment.

5. A valve operating system for an internal combustion engine according to claim 1, wherein at least that end of said hollow roller shaft, said switching pin is inserted into and removed from, has been subjected to a hardening treatment.

6. A valve operating system for an internal combustion engine according to claim 1, wherein said two cam followers disposed adjacent each other are disposed so that the other ends of the roller shafts which are devoid of the second groove are positioned to adjoin each other.

7. A valve operating system for an internal combustion engine according to claim 1, wherein each of said first and second grooves is formed into a C-shape, so that the relative rotation of said roller shaft and said support wall is limited by said C-shaped resilient fastener, and that area of the inner peripheral portion of the through-bore in said one support wall, which is sandwiched between opposite ends of said first groove, is disposed to correspond to a free end of said one support wall.

8. A valve operating system for an internal combustion engine according to claim 1, wherein each of said first and second grooves is formed into a C-shape, so that the relative rotation of said roller shaft and said support wall is limited by said C-shaped resilient fastener, and said cam followers include a particular cam follower which is not operatively connected to the engine valve in said disconnected state of the cam followers, the particular cam follower being provided with a portion receiving the biasing force of a biasing means for normally biasing said particular cam follower toward the corresponding cam, said receiving portion being disposed such that an area of the inner peripheral portion of the through-bore in said one support wall, which is sandwiched between opposite ends of said fist groove, corresponds to said receiving portion provided in said one support wall.

9. A valve operating system for an internal combustion engine according to claim 1, wherein each of said first and second grooves is formed into a C-shape, so that the relative rotation of said roller shaft and said support wall is limited by said C-shaped resilient fastener, and said cam followers include a particular cam follower which is not operatively connected to the engine valve in said disconnected state of the cam followers, said particular cam follower being engaged by biasing means for normally biasing said particular cam follower toward a corresponding cam that portion of said one support wall in the particular cam follower which is opposed to the biasing means, being formed thicker in a radial direction of said roller shaft, so that an outer surface of said portion protrudes toward said biasing means, said thicker portion being a portion receiving the biasing force of said biasing means and said first groove being located between two planes extending through opposite sides of said receiving portion and perpendicular to the axis of said roller shaft.

10. A valve operating system for an internal combustion engine according to claim 1, wherein each of said first and second grooves is formed into a C-shape, so that the relative rotation of said roller shaft and said support wall is limited by said C-shaped resilient fastener, and an area of the inner peripheral portion of the through-bore in said one support wall, which is sandwiched between opposite ends of said first groove, is disposed to correspond to that portion of said cam follower body to which a compressing load is applied during a lifting operation.

11. A valve operating system for an internal combustion engine according to claim 1, wherein each of said first and second grooves is formed into a C-shape, so that the relative rotation of said roller shaft and said support wall is limited by said C-shaped resilient fastener.

12. A valve operating system for an internal combustion engine according to claim 11, wherein opposite end faces of said fastener are formed flat and inclined with respect to a phantom plane extending radiately from the axis of said roller shaft toward the end of said fastener, and opposite inner end faces of said first and second C-shaped grooves opposed to said opposite end faces of said fastener are formed into flat faces parallel to the corresponding opposite end faces of said fastener, respectively.

13. A valve operating system for an internal combustion engine according to claim 12, wherein each of the inner end faces of said first groove is extended diametrically outwards past an outer peripheral edge portion of the fastener end face opposed to said inner end face of said first groove.

14. A valve operating system for an internal combustion engine according to claim 11, wherein a phantom plane connecting the axis of said roller shaft and the rotational axis of said cam passes through that area of the inner peripheral portion of the through-bore in said one support wall, which is sandwiched between the opposite ends of said first groove.

15. A valve operating system for an internal combustion engine according to claim 11, wherein a phantom plane connecting the axis of said roller shaft and the rotational axis of said cam passes through a central portion of that area of the inner peripheral portion of the through-bore In said one support wall, which is sandwiched between the opposite ends of said first groove.

16. A valve operating system for an internal combustion engine according to any one of claims 1 to 15, wherein said cam follower body is formed of an aluminum-based metal material.

17. A valve operating system for an internal combustion engine according to claim 1, wherein the inner surface of said second groove in the outer peripheral surface of said roller shaft has been subjected to a hardening treatment.

18. A valve operating system for an internal combustion engine according to claim 1, wherein at least that end of said hollow roller shaft, which said switching pin is inserted into and removed from, has been subjected to a hardening treatment.

19. A valve operating system for an internal combustion engine according to claim 1, wherein said roller is carried on the outer periphery of said roller shaft through needles, and that area of the outer peripheral surface of said roller shaft, which extends from a central needle-rolling face to an outer area past inner end edges of the through-bores, has been subjected at least to a hardening treatment.

20. A valve operating system for an internal combustion engine according to claim 1, wherein the inner surface of said second groove in the outer peripheral surface of said roller shaft has been subjected to a hardening treatment.

21. A valve operating system for an internal combustion engine according to claim 1, wherein at least that end of said hollow roller shaft, which said switching pin is inserted into and removed from, has been subjected to a hardening treatment.

22. A valve operating system for an internal combustion engine, comprising at least two rollered cam followers arranged adjacent each other and having rollers put in contact with a plurality of cams, said cam followers, excluding one of them, being operatively connected to an engine valve, so that the valve operating characteristic of said engine valve can be changed by moving a switching pin mounted in adjacent ones of said cam followers for sliding movement astride said adjacent cam followers, thereby enabling connected and disconnected states of the cam followers to be switched over from one to another, said one cam follower being provided with a portion receiving the biasing force of a biasing means for normally biasing said one cam follower toward a corresponding valve operating cam, wherein said one cam follower comprises a cam follower body having a pair of support walls integrally provided thereon and arranged in parallel to sandwich said roller therebetween, and a roller shaft which is fitted and supported at outer peripheries of opposite ends thereof in through-bores in said support walls, said roller shaft having the roller rotatably carried on an intermediate portion thereof, and said valve operating system further includes a first groove which is defined in an inner peripheral surface of the through-bore on one of said support walls to extend in a circumferential direction of said through-bore, a second groove which is defined in an outer peripheral surface of one end of said roller shaft corresponding to said first groove, and a C-shaped resilient fastener mounted in said first and second grooves and capable of engaging with inner surfaces of said grooves astride the grooves to limit an axial relative movement of said roller shaft and said support walls, said receiving portion being formed on the other support wall.

23. A valve operating system for an internal combustion engine according to claim 22, wherein said roller is carried on the outer periphery of said roller shaft through needles, and that area of the outer peripheral surface of said roller shaft, which extends from a central needle-rolling face to an outer area past inner end edges of said through-bores, has been subjected at least to a hardening treatment.

24. A valve operating system for an internal combustion engine according to claim 22, wherein the inner surface of said second groove in the outer peripheral surface of said roller shaft has been subjected to a hardening treatment.

25. A valve operating system for an internal combustion engine according to claim 22, wherein at least that end of said hollow roller shaft, said switching pin is inserted into and removed from, has been subjected to a hardening treatment.

26. A valve operating system for an internal combustion engine according to claim 22, wherein each of said first and second grooves is formed into a C-shape, so that the relative rotation of said roller shaft and said support wall is limited by said C-shaped resilient fastener.

27. A valve operating system for an internal combustion engine according to claim 26, wherein opposite end faces of said fastener are formed flat and inclined with respect to a phantom plane extending radiately from the axis of said roller shaft toward the end of said fastener, and opposite inner end faces of said first and second C-shaped grooves opposed to said opposite end faces of said fastener are formed into flat faces parallel to the corresponding opposite end faces of said fastener, respectively.

28. A valve operating system for an internal combustion engine according to claim 27, wherein each of the inner end faces of said first groove are extended radially outwards past an outer peripheral edge portion of the fastener end face opposed to said inner end face of said first groove.

29. A valve operating system for an internal combustion engine according to any one of claims 22 to 28, wherein said cam follower body is formed of an aluminum-based metal material.

30. A valve operating system for an internal combustion engine, comprising at least two rollered cam followers arranged adjacent each other and having rollers put in contact with a plurality of cams, at least one of the cam followers being operatively connected to an engine valve, so that the valve operating characteristic of said engine valve can be changed by moving a switching pin mounted in adjacent one of said cam followers for sliding movement astride the adjacent cam followers, thereby enabling connected and disconnected states of the cam followers to be switched over from one to another, wherein each of said cam followers comprises a cam follower body having a pair of support walls integrally provided thereon and arranged in parallel to sandwich the roller therebetween, and a hollow roller shaft which is fitted and supported at outer peripheries of opposite ends thereof in through-bores in said support walls, said roller shaft having the roller rotatably carried at an intermediate portion thereof, and said system further includes a first groove defined in an inner peripheral surface of the through-bore in one of the support walls of another of said adjacent cam followers that receives said switching pin in said connected state, so as to extend in a circumferential direction of the through-bore, a second groove defined in an outer peripheral surface of the roller shaft at one end thereof corresponding to the first groove, and a C-shaped resilient fastener mounted in the first and second grooves and capable of engaging with inner surfaces of said grooves astride the grooves to limit an axial relative movement of said roller shaft and said one support wall, said switching pin being slidably fitted to inner peripheral surfaces of said roller shafts of said adjacent cam followers, wherein said one support wall in said another cam follower is located close to said one cam follower in which said switching pin is mounted.

31. A valve operating system for an internal combustion engine according to claim 30, wherein said roller is carried on the outer periphery of said roller shaft through needles, and that area of the outer peripheral surface of said roller shaft, which extends from a central needle-rolling face to an outer area past inner end edges of the through-bores, has been subjected at least to a hardening treatment.

32. A valve operating system for an internal combustion engine according to claim 30, wherein the inner surface of said second groove in the outer peripheral surface of said roller shaft has been subjected to a hardening treatment.

33. A valve operating system for an internal combustion engine according to claim 30, wherein at least that end of said hollow roller shaft, which said switching pin is inserted into and removed from, has been subjected to a hardening treatment.

34. A valve operating system for an internal combustion engine, comprising at least two rollered cam followers arranged adjacent each other and having rollers put in contact with a plurality of cams, at least one of the cam followers being operatively connected to an engine valve, so that the valve operating characteristic of said engine valve can be changed by moving a switching pin mounted in adjacent one of said cam followers for sliding movement astride the adjacent cam followers, thereby enabling connected and disconnected states of the cam followers to be switched over from one to another, wherein each of said cam followers comprises a cam follower body having a pair of support walls integrally provided thereon and arranged in parallel to sandwich the roller therebetween, one of said support walls being provided therein with a passage for feeding hydraulic pressure for a switch-over operation by the pin, and a hollow roller shaft which is fitted and supported at outer peripheries of opposite ends thereof in through-bores in said support walls, said roller shaft having the roller rotatably carried at an intermediate portion thereof; and said system further includes a first groove defined in an inner peripheral surface of the though-bore in the other of the support walls to extend in a circumferential direction of the through-bore, a second groove defined in an outer peripheral surface of the roller shaft at one end thereof corresponding to the first groove, and a C-shaped resilient fastener mounted in the first and second grooves and capable of engaging with inner surfaces of said grooves astride the grooves to limit an axial relative movement of said roller shaft and said other support wall, said switching pin being slidably fitted to inner peripheral surfaces of said roller shafts of said adjacent cam followers.

35. A valve operating system for an internal combustion engine according to claim 34, wherein said roller is carried on the outer periphery of said roller shaft through needles, and that area of the outer peripheral surface of said roller shaft, which extends from a central needle-rolling face to an outer area past inner end edges of the through-bores, has been subjected at least to a hardening treatment.

36. A valve operating system for an internal combustion engine, comprising at least two rollered cam followers arranged adjacent each other and having rollers put in contact with a plurality of cams, at least one of the cam followers being operatively connected to an engine valve, so that the valve operating characteristic of said engine valve can be changed by moving a switching pin mounted in adjacent one of said cam followers for sliding movement astride the adjacent cam followers, thereby enabling connected and disconnected states of the cam followers to be switched over from one to another, wherein each of said cam followers comprises a cam follower body having a pair of support walls integrally provided thereon and arranged in parallel to sandwich the roller therebetween, and a hollow roller shaft which is fitted and supported at outer peripheries of opposite ends thereof in a through-bore in one of said support walls and in a recessed portion in the other of said support walls, said roller shaft having the roller rotatably carried at an intermediate portion thereof; and said system further includes a first groove defined in an inner peripheral surface of the through-bore in said one support wall to extend in a circumferential direction of the through-bore, a second groove defined in an outer peripheral surface of the roller shaft at one end thereof corresponding to the first groove, and a C-shaped resilient fastener mounted in the first and second grooves and capable of engaging with inner surfaces of said grooves astride the grooves to limit an axial relative movement of said roller shaft and said one support wall, said switching pin being slidably fitted to inner peripheral surfaces of said roller shafts of said adjacent cam followers.

* * * * *